US005367134A

United States Patent [19]

Yoshizumi et al.

[11] Patent Number: 5,367,134

[45] Date of Patent: Nov. 22, 1994

[54] CIRCUIT BREAKER

[75] Inventors: Toshiaki Yoshizumi; Mikio Hidaka; Yoshiki Hirano, all of Amagasaki, Japan

[73] Assignee: Mitsubishi Denki Kabushiki Kaisha, Tokyo, Japan

[21] Appl. No.: 46,997

[22] Filed: Apr. 16, 1993

[30] Foreign Application Priority Data

Apr. 16, 1992 [JP] Japan ..... 4-096515

[51] Int. Cl.[5] ..... H01H 33/34; H01H 33/42; H01H 33/52

[52] U.S. Cl. ..... 200/148 F; 200/145; 200/148 D

[58] Field of Search ..... 200/148 A, 144 R, 144 B, 200/144 AP, 145, 148 R, 148 D, 148 F, 148 B, 150 D, 150 E, 150 F, 17 R

[56] References Cited

U.S. PATENT DOCUMENTS 4,215,256 7/1980 Sakaguchi et al. ..... 200/148 D
4,454,394 6/1984 Toyoda ..... 200/145
4,581,510 4/1986 Bischofberger et al. ..... 200/148 F

*Primary Examiner*—A. D. Pellinen
*Assistant Examiner*—Michael A. Friedhofer
*Attorney, Agent, or Firm*—Oblon, Spivak, McClelland, Maier, & Neustadt

[57] ABSTRACT

In a closing operation of a circuit breaker with resistor contact, a resister contact is closed prior to closing of a main contact by the same first hydraulic operation system. In opening operation, the resistor contact is driven by a second hydraulic operation system used to close the main contact after operating the main contact by the first hydraulic operation system. Opening timing of the resistor contact is controlled by a mechanical interlock mechanism or hydraulic control circuit.

17 Claims, 29 Drawing Sheets

CIRCUIT BREAKER

BACKGROUND OF THE INVENTION

1. Field of the Invention

The present invention relates to a circuit breaker to be used in an electric power system.

2. Description of the Prior Art

A conventional circuit breaker which is a double-break type gas-insulated circuit breaker with closing resistors is described referring to FIGS. 24 to 29.

FIG. 24 is a sectional side view showing a constitution of the conventional circuit breaker in a closed state. In FIG. 24, elements which are positioned in left-hand half part in the figure are further sectioned and elements in right-hand half part are not sectioned. The elements in left-hand half part and the elements in right-hand half part are substantially the same and positioned substantially symmetrical, In FIG. 24, an insulation gas such as $SF_6$ gas in the space 102 is filled in a main tank 101. Two main contacts 200 are symmetrically positioned with respect to the center of the main tank 101 and they are supported by a frame conductor 301. The frame conductor 301 is supported by an insulation holder 302 in a center branch drum port of the main tank 101. The main contacts 200 and the frame conductor 301 are positioned on a center axis of the main tank 101. The main contacts 200 respectively consist of a stationary electrode 201 and a moving electrode 202.

FIG. 25 is a sectional side view showing a detailed constitution of a switching part of the conventional circuit breaker. As shown in FIG. 25, the stationary electrode 201 and the moving electrode 202 are held by an insulation tube 203. Conductors 204 of the stationary electrodes 201 serve as cooling drums for cooling hot insulation gas in an opening operation of the circuit breaker. In rear parts of the conductors 204, exhaust openings 204*a* are formed for exhausting the hot insulation gas therethrough. Connection parts 105 are respectively provided on the conductors 204 to be connected to connection conductors 104 which are respectively held by insulation spacers 103 at the both ends of the main tank 101, as shown in FIG. 24.

As shown in FIGS. 24 and 25, the insulation tubes 203 respectively have a cylindrical shape. Capacitors 106 are provided on outer peripheries of respective of the insulation tubes 203, and they are electrically connected in parallel with the main contacts 200 in a manner to share voltages of the main contacts 200 evenly. On outer peripheries of respective of the conductors 204, two sets of plural resistors 500 are provided for restraining the surge when the circuit is closed. Resistor contacts 400 are respectively connected in series with respective sets of the resistors 500. The resistor contacts 400 are respectively provided on the outer peripheries of the insulation tubes 203 and obliquely below the main contacts 200. Furthermore, series connections of the resistor contact 400 and the resistors 500 are electrically connected in parallel with the main contacts 200. The moving electrodes 202 of the main contacts 200 and moving resistor contacts 409 of the resistor contacts 400 are respectively coupled with an insulated operation rod 303 via a link mechanism 300 which is provided in the frame conductor 301. The link mechanism 300 is connected to a hydraulic operation apparatus 700 in an operation housing 107 via another link mechanism 600 which is provided in the air.

Constitutions of the above-mentioned individual elements are described in detail. FIG. 25 shows a breaking state of the conventional circuit breaker. In FIG. 25, each of the stationary electrode 201 of the main contact 200 consists essentially of a main stationary contact 205, a stationary arc contact 206, a shield 207 and the conductor 204. The moving electrode 202, which is positioned opposing to the stationary electrode 201, consists essentially of a main moving contact 208, a moving arc contact 209, a nozzle 210, a puffer cylinder 211, a piston 213 and a finger contact 214. A piston rod 212 of the piston 213 is slidably-held on the frame conductor 301 in a manner to make the finger contact 214 serve as a guide. A stationary resistor contact 401, which is positioned obliquely below the stationary electrode 201, is slidably held on a resistor contact case 402. The resistor contact case is fixed on the shield 207 via an insulation base 403.

As shown in FIG. 25, each piston rod 212 is linked to a main lever 305 via a link 304. Each of the main lever 305 is rotatably held on the frame conductor 301. The insulation rod 303 is coupled to both (right and left sides in the figure) of the main levers 305 via other links 306. Each of the moving resistor contact 409 is linked to an end 308*a* of a lever 308 via a link 307. Each of the lever 308 is rotatably borne at substantially the center thereof by a pin 309. The pin 309 is provided at substantially the center between a rotation center of the main lever 305 and a coupling part of the link 304 and the main lever 305. The other end of the lever 308 is rotatably borne on a seventh link 310. The seventh link 310 is rotatably borne on the frame conductor 301. In such a link mechanism, the motion of the link part of the link 307 and the lever 308 caused by the rotation of the main lever 305 can be considered as a substantial linear motion, and thereby any transverse force does not occur in the moving resistor contact 409.

An upper end 303*a* of the insulation rod 303 is guided by a guide 311 which is provided on the frame conductor 301, and a lower end 303*b* of the insulation rod 303 is fixed on a shaft 601. The insulation rod 303 is positioned at the center of the insulation holder 302. The shaft 601 penetrates the center of the bottom face 302*a* of the insulation holder 302. A shaft seal 602 is provided between the shaft 601 and the insulation holder 302 for permitting the sliding motion of the shaft 601 while maintaining the seal of the $SF_6$ gas in the space 102 in the main tank 101. An end 601*a* of the shaft 601 in the air is coupled to a hydraulic piston 701 of the hydraulic operation apparatus 700 via a link mechanism which is constituted by an eighth link 603, a conversion lever 604 for perpendicularly converting the moving direction and a rod end 605.

The hydraulic operation apparatus 700 further comprises an accumulator for charging the oil and a oil pump unit (not shown in the figure) for increasing the pressure of the oil.

FIG. 26 shows a detail constitution of the resistor contact 400 in a breaking state of the circuit breaker. In FIG. 26, a restoration spring 404 is provided in an inner space of the resistor contact 401. An end 404*a* of the restoration spring 404 contacts an inside face 401*a* of the resistor contact 401 and the other end 404*b* of the restoration spring 404 contacts a piston 405 which is fixed on the resistor contact case 402. In the breaking state, the resistor contact 401 is pushed out by a pressing force of the restoration spring 404, since the resistor contact case 402 serves as a stopper. Orifices 406 are provided on the piston 405 for serving as a damper when the stationary resistor contact 401 slides. On the outer surface of the stationary resistor contact 401, a contact piece 407 is provided for electrically connecting the stationary resistor contact 401 to the resistor contact case 402. On an extension of the center axis of the stationary resistor contact 401, resistor elements 501 are provided via an adapter 408 in a manner to be connected electrically in series to the stationary resistor contact 401. The moving resistor contact 409, which is positioned opposing to the stationary resistor contact 401, is movably held by the frame conductor 301 and electrically connected to the frame conductor 301 by a contact piece 410.

FIG. 27 shows an installation of the resistors 500. For restoring the surge which occurs in the closing operation of the circuit breaker, the resistor contact 400, which is provided in parallel with the main contact 200, is closed prior to the closing of the main contact 200. And thereby, the resistors 500 which are provided in series with the resistor contact 400 are electrically connected. Generally, each of the resistor 500 consists of series connection of many resistor elements 501, and thereby a necessary valve of the resistor 500 or the series connection of the resistors 500 is/are given by the series connection of the resistor elements 501. And the heat load of the resistor 500 is partially shared by the resistor elements 501. Each of the resistor element 501 has a disk shape and is held by an insulation bar 502 which penetrates the center hole of the resistor element 501. An end 502*a* of the insulation bar 502 is fixed on an adapter 408 and the other end 502*b* is fixed on a conductor 503 which is used for connecting another resistor 500'. Another adapter 504 is provided to electrically contact with the left side of the series connection of the resistor elements 501 in the figure. A coil spring 505 is provided between the conductor 503 and the adapter 504 for supplying a pressure to the resistor elements 501. The conductor 503 is shielded by a shield 506 which is used for weakening the electric field. Similarly, the next resistors 500' and 500'' are electrically connected in series to each other and held by an insulation base 507 on a shield 207. The other end 510 of the series connection of the resistors 500' and 500'' is electrically connected to a conductor 204, and thereby the main contact 200 is electrically connected across both ends of the series connection of the resistors 500, 500' and 500'.

The motion of the conventional circuit breaker is described. The closing motion shown in FIG. 25 is executed as follows. By receiving a closing command (from a control apparatus not shown in the figure), the piston 701 of the hydraulic operation apparatus 700 and the rod end 605 start to move in left-hand half part in the figure. Thereby, the lever 604 rotates counterclockwise, and the shaft 601 moves upward via the eighth link 603. The elements which are positioned in right- and left-hand half parts in the figure move symmetrically, so that the explanation of the motion is made mainly referring to the left-hand half part ones.

When the shaft 601 moves upward, the insulated operation rod 303 also moves upward. The main lever 305, which is coupled to the insulated operation rod 303 via the link 306, rotates counterclockwise. As a result, the puffer cylinder 211 of the main contact 200 is moved in left-hand half part via the link 304 and the piston rod 212.

On the other hand, the lever 308, which is linked to the main lever 305 by the pin 309, rotates clockwise around the coupling point 308*b* to the seventh link 310 by the counterclockwise rotation of the main lever 305. The moving resistor contact 409 moves in lefthand half part to approach the stationary resistor contact 401 via the link 307. At first, the moving resistor contact 409 contacts the stationary resistor contact 401, and thereby, the resistor contact 400 turns to a closing state. At this time, the moving resistor contact 409 pushes the stationary resistor contact 401, and the restoration spring 404 is compressed by pushing of the stationary resistor contact 401 to the resistor contact case 402. Next, the moving arc contact 209 contacts the stationary arc contact 206. Furthermore, the main moving contact 208 contacts the main stationary contact 205. Thereby, the main contact 200 is closed.

The stationary resistor contact 401 is constituted to be able to move with the motion of the moving resistor contact 409. When the stationary resistor contact 401 is pressed by the moving resistor contact 409, the insulation gas in the space 102 of $SF_6$ in a space formed between the piston 405 and the stationary resistor contact 401 is compressed. When the compressed insulation gas in the space 102 is exhausted from the orifice 406, the resistance serves as a damping force. When the piston. 701 reaches a closing position, the closing motion of the circuit breaker has been completed. The closing state of the conventional circuit breaker is shown in FIG. 28.

Next, the breaking motion of the conventional circuit breaker is described. From the closed state of the conventional circuit breaker shown in FIG. 28, when a breaking command is issued from the control apparatus (not shown in the figure), the piston 701 of the hydraulic operation apparatus 700 and the rod end 605 start to move in right-hand half part in the figure. The lever 604 rotates clockwise and the shaft 601 moves downward via the eighth link 603.

When the shaft 601 moves downward, the insulated operation rod 303 also moves downward. The main lever 305, which is linked to the insulated operation rod 303 via the link 306, rotates clockwise. And the puffer cylinder 211 of the main contact 200 moves to the frame conductor 301 which is positioned in the center of the main tank 101 via the link 304 and the piston rod 212.

On the other hand, the lever 308, which is linked to the main lever 305 by the pin 309, rotates counterclockwise around the coupling point 308*b* to the seventh link 310 following clockwise rotation of the main lever 305. At that time, the moving resistor contact 409 also moves to the frame conductor 301 via the link 307. The stationary resistor contact 401 moves rightward by the pressure of the restoration spring 404 following the rightward movement of tile moving resistor contact 409 rightward. However, the moving speed of the stationary resistor contact 401 is slower than that of the moving resistor contact 401, since the charged energy of the restoration spring 404 is small and the orifice formed on the piston 405 serves as a damper. Therefore, the resistor contact 400 soon becomes breaking state. After that, the main moving contact 208 of the main contact departs from the main stationary contact 205. The moving arc contact 209 also departs from the stationary arc contact 206, and an arc occurs between them. A state on the way of the opening operation of the conventional circuit breaker is shown in FIG. 29.

The insulation gas in the space 102 compressed by the piston 213 and the puffer cylinder 211 blows the arc, and thereby, the current flowing in the circuit breaker is cut. Most of the insulation gas in the space 102 heated by the arc passes through the conductor 204. The insulation gas in the space 102 is cooled by the conductor 204 and exhausted from the opening 204*a*. When the piston 701 reaches the breaking position, the opening operation of the conventional circuit breaker has been completed. The breaking state of the conventional circuit breaker is shown in FIG. 25.

When the voltage of the electric power system becomes higher and the conventional circuit breaker is used, for example, in 1000 kv system, it is demanded to restrain an overvoltage, not only in the closing operation but also in the opening operation, of the circuit breaker, in order to design a transmission-transformation system and/or transmission lines economically. In the conventional circuit breaker configured above, the resistor contact 400 is broken prior to the breaking of the main contact 200. Therefore, the overvoltage in the opening operation can not be restrained. For restraining the overvoltage in the opening operation too, a resistor-breaking type circuit breaker, which keeps to contact a resistor contact for a predetermined time period after breaking the main contact, is necessary. For such time period of the contacting time of the resistor contact, a time of about 25 ms is necessary for a computer simulation of the model system. The time period of 25 ms in the opening operation is longer than that of 10 ms in the closing operation.

On the other hand, in general, the circuit breaker is demanded to operate faster in the opening operation than in the closing operation for obtaining a high circuit breaking performance. For satisfying such the condition, it is necessary that the resistor contact is opened in the vicinity of the final step of the opening operation after the main contact is opened. Therefore, another special driving apparatus and a delay operation mechanism are demanded to constitute the high-voltage type circuit breaker.

OBJECT AND SUMMARY OF THE INVENTION

The present invention has been made in order to solve the above-mentioned problems. An object of the present invention is to provide an improved circuit breaker fitting to the high voltage electric power system with down sizing and high reliability of the moving mechanism.

A circuit breaker in accordance with the present invention comprises:

a tank filled with an insulation gas;

two main contacts which are electrically connected in series and provided in the tank in a manner that main moving contacts of the main contacts are driven in the axial direction of the tank for contacting and departing from stationary main contacts of the main contacts;

series connections of resistors and a resistor contact which are respectively provided in the tank in a manner being electrically connected in parallel with the main contacts;

a first insulation operation rod and a second insulation operation rod which are driven in a direction perpendicular to the axis of the tank and provided between the main contacts;

first link mechanism for coupling between top end of the first insulation operation rod and the main contact;

second link mechanism for coupling between top end of the second insulation operation rod and the resistor contact;

a first hydraulic operation apparatus and a second hydraulic apparatus which are provided below the tank;

third link mechanism for coupling between bottom end of the first insulation operation rod and the first hydraulic operation apparatus;

fourth link mechanism for coupling between bottom end of the second insulation operation rod and the second hydraulic operation apparatus.

Furthermore, a circuit breaker in accordance with the present invention comprises:

a tank filled with an insulation gas;

a pair of main contacts disposed in the tank in a manner that moving directions of main moving contacts thereof are opposing to each other;

a first insulated operation rod driven in a direction perpendicular to the moving directions of the main moving contacts;

first link mechanism comprising: a first link which is coupled to a top end of the first insulated operation rod; a second link which is coupled to the main moving contact; and a first lever which is coupled between the first link and the second link and rotatably borne on the tank;

a pair of series connection of a resister and a resister contact disposed in the tank in a manner that moving directions of moving resister contacts thereof are opposing to each other;

a second insulated operation rod in the tank in a manner that moving direction thereof is perpendicular to the moving directions of the moving resister contacts;

second link mechanism comprising: a third link which is coupled to a top end of the second insulated operation rod; a fourth link which is coupled to the moving resister contact; and a second lever which is coupled between the third link and the fourth link and rotatably borne on the tank;

fifth link mechanism comprising: a seventh link, an end thereof being rotatably borne on the tank; a third lever rotatably borne on the first lever, an end thereof being coupled to the other end of the seventh link; a fifth link, an end thereof being coupled to the other end of the third lever; a sixth link coupled between the other end of the fifth link and the other end of the second lever; and the fifth and sixth links being folded when the main contacts and the resister contacts are at opened and closed positions;

a first and second hydraulic operation apparatuses respectively provided below the tank;

third link mechanism disposed below the first insulated operation rod and comprising: a first shaft which is connected to a bottom end of the first insulated operation rod and arranged to project to air from the tank through a first hermetic seal; a fourth lever rotatably borne on an operation housing; an eighth link connected between an end of the fourth lever and a bottom end of the First shaft; and a first rod end coupled between the other end of the fourth lever and an end of a first hydraulic piston of the first hydraulic operation apparatus;

fourth link mechanism disposed below the second insulated operation rod and comprising: a second shaft which is connected to a bottom end of the second insulated operation rod and arranged to project to air from the tank through a second hermetic seal; a fifth lever rotatably borne on an operation housing; an ninth link connected between an end of the fifth lever and a bottom end of the second shaft; and a second rod end coupled between the other end of the fifth lever and an end of a second hydraulic piston of the second hydraulic operation apparatus; and interlock means provided between the third and Fourth link mechanisms in a manner that in case of opening operation of the main contacts and the resister contacts, the interlock means engages the fourth link mechanism for holding a driving force of the second hydraulic operation apparatus, the main contacts are opened when the fourth lever of the third link mechanism rotates a first predetermined angle, engagement of the interlock means and the fourth link mechanism are released when the fourth lever further rotates a second predetermined angle, and thereby the resister contacts are opened by the driving force of the second hydraulic operation apparatus.

Furthermore, a circuit breaker in accordance with the present invention comprises:

interlock means provided between the third link mechanism and the fourth link mechanism for restricting the motion of the fourth link mechanism in a predetermined time period in the opening operation of the circuit breaker, thereby the resister contact are driven after the opening of the main contacts.

Still furthermore, a circuit breaker in accordance with the present invention comprises:

fifth link mechanism for linking the first and second link mechanisms in a manner that the resistor contacts are closed prior to the closing of the main contacts in the closing operation of the circuit breaker.

Still furthermore, in a circuit breaker in accordance with the present invention, the first hydraulic operation apparatus has closing operation control means for converting an electric closing signal to a hydraulic closing signal, thereby the first hydraulic operation apparatus starts to close the main contacts;

the hydraulic signal is applied to the second hydraulic operation apparatus at the same time, thereby the second hydraulic operation apparatus starts to close the resister contacts; and driving speed of the second hydraulic operation apparatus is faster than that of the first hydraulic operation apparatus.

Still furthermore, a circuit breaker in accordance with the present invention comprises:

a trigger means for detecting a predetermined motion of the third link mechanism and converting a mechanical motion of the third link mechanism to a hydraulic opening signal; and wherein the first hydraulic operation apparatus has an opening operation control means for converting an electric opening signal to a hydraulic opening signal, thereby the first hydraulic operation apparatus starts to open the main contacts; and the interlock means is released by a motion of the third link mechanism when the third link mechanism moves a predetermined stroke after opening the main contacts; and the trigger means supplies the hydraulic opening signal to the second hydraulic operation apparatus, thereby the second hydraulic operation apparatus starts to open the resister contacts via the third link mechanism.

Still furthermore, a circuit breaker in accordance with the present invention comprises:

means for detecting that a first hydraulic piston of the first hydraulic operation apparatus reaches to a limit position in the opening operation, and outputting a hydraulic opening signal to the second hydraulic operation apparatus, thereby the second hydraulic operation apparatus starting to opening the resister contacts.

Still furthermore, a circuit breaker in accordance with the present invention comprises:

closing operation control means for converting an electric closing signal to a hydraulic closing signal provided on the first hydraulic operation apparatus or the second hydraulic operation apparatus in closing operation of the main contacts and the resister contacts;

a pipe line for transmitting the hydraulic closing signal from the closing operation control means to the other of the hydraulic operation apparatus, thereby the main contacts and the resister contacts being started to be closed at the same time when the electric closing signal is inputted to the closing operation control means;

opening operation control means for converting an electric opening signal to a hydraulic opening signal provided on the first hydraulic operation apparatus in opening operation of the main contacts and the resister contacts, thereby, the main contacts being started to open by the first hydraulic operation apparatus via the third link mechanism when the electric opening signal is inputted to the opening operation control means;

trigger means driven by the fourth lever of the third link mechanism when the fourth lever rotates a predetermined angle after opening of the main contacts;

mechanical link means for transmitting motion of the trigger means to the second hydraulic operation apparatus; and converting means for converting the motion of the trigger means to a hydraulic opening signal, thereby the second hydraulic operation apparatus starting to open the resister contacts.

Still furthermore, a circuit breaker in accordance with the present invention comprises:

closing operation control means for converting an electric closing signal to a hydraulic closing signal provided on the first hydraulic operation apparatus or the second hydraulic operation apparatus In closing operation of the main contacts and the resister contacts;

a pipe line for transmitting the hydraulic closing signal from the closing operation control means to the other of the hydraulic operation apparatus, thereby the main contacts and the resister contacts being started to be closed at the same time when the electric closing signal is inputted to the closing operation control means;

opening operation control means for converting an electric opening signal to a hydraulic opening signal provided on the first hydraulic operation apparatus in opening operation of the main contacts and the resister contacts, thereby, the main contacts being started to open by the first hydraulic operation apparatus via the third link mechanism when the electric opening signal is inputted to the opening operation control means; and hydraulic circuit means for detecting that the first hydraulic piston of the first hydraulic operation apparatus reaches to a limit position and outputting a predetermined hydraulic signal to the second hydraulic operation apparatus via a pipe line, thereby the second hydraulic operation apparatus starting to open the resister contacts.

Still furthermore, a circuit breaker in accordance with the present invention comprises:

a tank filled with an insulation gas;

two main contacts which are electrically connected in series and provided in the tank in a manner that main moving contacts of the main contacts are driven in the axial direction of the tank for contacting and departing from stationary main contacts of the main contacts;

series connections of resistors and a resistor contact which are respectively provided in the tank in a manner being electrically connected in parallel with the main contacts;

a first insulation operation rod and a second insulation operation rod which are driven in a direction perpendicular to the axis of the tank and provided between the main contacts;

first link mechanism for coupling between one end of the first insulation operation rod and the main contact;

second link mechanism for coupling between one end of the second insulation operation rod and the resistor contact;

a first hydraulic operation apparatus and a second hydraulic apparatus which are provided below the tank;

third link mechanism for coupling between the other end of the first insulation operation rod and the first hydraulic operation apparatus;

fourth link mechanism for coupling between the other end of the second insulation operation rod and the second hydraulic operation apparatus; and fifth link mechanism for linking the first and second link mechanisms in a manner that the resistor contacts are closed prior to the closing of the main contacts in the closing operation of the circuit breaker: and interlock means provided between the third link mechanism and the fourth link mechanism for restricting the motion of the fourth link mechanism in a predetermined time period in the opening operation of the circuit breaker, thereby the resister contact are driven after the opening of the main contacts.

Still furthermore, in a circuit breaker in accordance with the present invention.

the second hydraulic operation apparatus comprises: a second hydraulic piston which is coupled to the fourth link mechanism; a cylinder wherein the second hydraulic piston is contained; and an accumulator connected to inner space of the cylinder through a pipe line for always supplying a high-pressure oil to the second hydraulic piston In a predetermined direction; and a driving force opposing to the predetermined direction is applied to the second hydraulic piston for charging a hydraulic driving force in the second hydraulic operation apparatus when the main contacts and the resister contact are driven in closing operation by the first hydraulic operation apparatus.

Still furthermore, in a circuit breaker in accordance with the present invention.

the first hydraulic operation apparatus and the second hydraulic operation apparatus are positioned in a manner that motion of the first and second hydraulic pistons are substantially horizontal and the moving direction of them are opposing to each other, but the elevations of the first and second hydraulic apparatuses are different; and the interlock means for restricting the motion of the fourth link mechanism is disposed between the third link mechanism and the fourth link mechanism.

Still more, a circuit breaker in accordance with the present invention, comprises:

a pair of the first Insulation operation rods are provided symmetrical to the second insulated operation rod;

a pair of the first hydraulic operation apparatuses provided below the tank;

a pair of the first link mechanism are respectively provided for coupling between top ends of the first insulation operation rods and the main contacts; and a pair of third link mechanisms are respectively provided for coupling between the bottom ends of the first insulation operation rods and the first hydraulic operation apparatuses.

Still furthermore, in a circuit breaker in accordance with the present invention, the pair of first hydraulic operation apparatuses are disposed in a manner that the moving direction of the first hydraulic pistons are opposing to each other;

the second hydraulic operation apparatus is disposed in a manner that moving direction of the second hydraulic piston is substantially the same as one of moving directions of the first hydraulic pistons, but the elevation of the second hydraulic operation apparatus is different from those of the first hydraulic operation apparatuses; and the interlock means for restricting the motion of the fourth link mechanism is disposed between a pair of the third link mechanisms and the fourth link mechanism.

In the circuit breaker in accordance with the present invention which is configured above, the main contacts are operated by the first hydraulic operation apparatus via the first insulated operation rod, and the resistor contacts are operated by the second hydraulic operation apparatus via the second insulated operation rod.

The main moving contact of the main contact and the first insulated operation rod 1s coupled by the first link mechanism, the moving resister contact of the resister contact and the second insulated operation rod is coupled by the second link mechanism, and the first and second link mechanisms are coupled by the fifth link mechanism. Thereby, in the closing operation of the main contacts and the resistor contacts of the above-mentioned circuit breaker of the present Invention, the main contacts and the resistor contacts can be operated in a constant timing that the main contacts are closed after the resistor contacts are in the closed state.

In the opening operation of the main contacts and the resistor contacts of the above-mentioned circuit breaker, the fourth link mechanism, which is locked by The engagement with the latch, is released when the main contact is broken and the latch is released from the fourth link mechanism by the rotation of the fifth lever at a predetermined angle. Therefore, even if the circuit breaker receives a mechanical shock or vibration owing to the opening operation of the main contact, the resistor contact is kept to be in closed state until the predetermined time passes since the main contact is broken. As a result, the circuit breaker in accordance with the present invention is advantageous in its reliability of the opening operation.

Furthermore, in the circuit breaker in accordance with the present invention, the first and second hydraulic operation apparatuses are disposed in a manner that the elevations of them are different from each other, and the directions of the driving forces of them are opposing to each other. Thereby, the first and second hydraulic operation apparatuses are contained in the same housing, and the interlock mechanism is easily provided between the first and second hydraulic operation apparatuses.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

In the following paragraphs, a circuit breaker of the present invention will be described in detail concerning the preferred embodiments shown in the attached drawings.

First Embodiment

Figure 1:
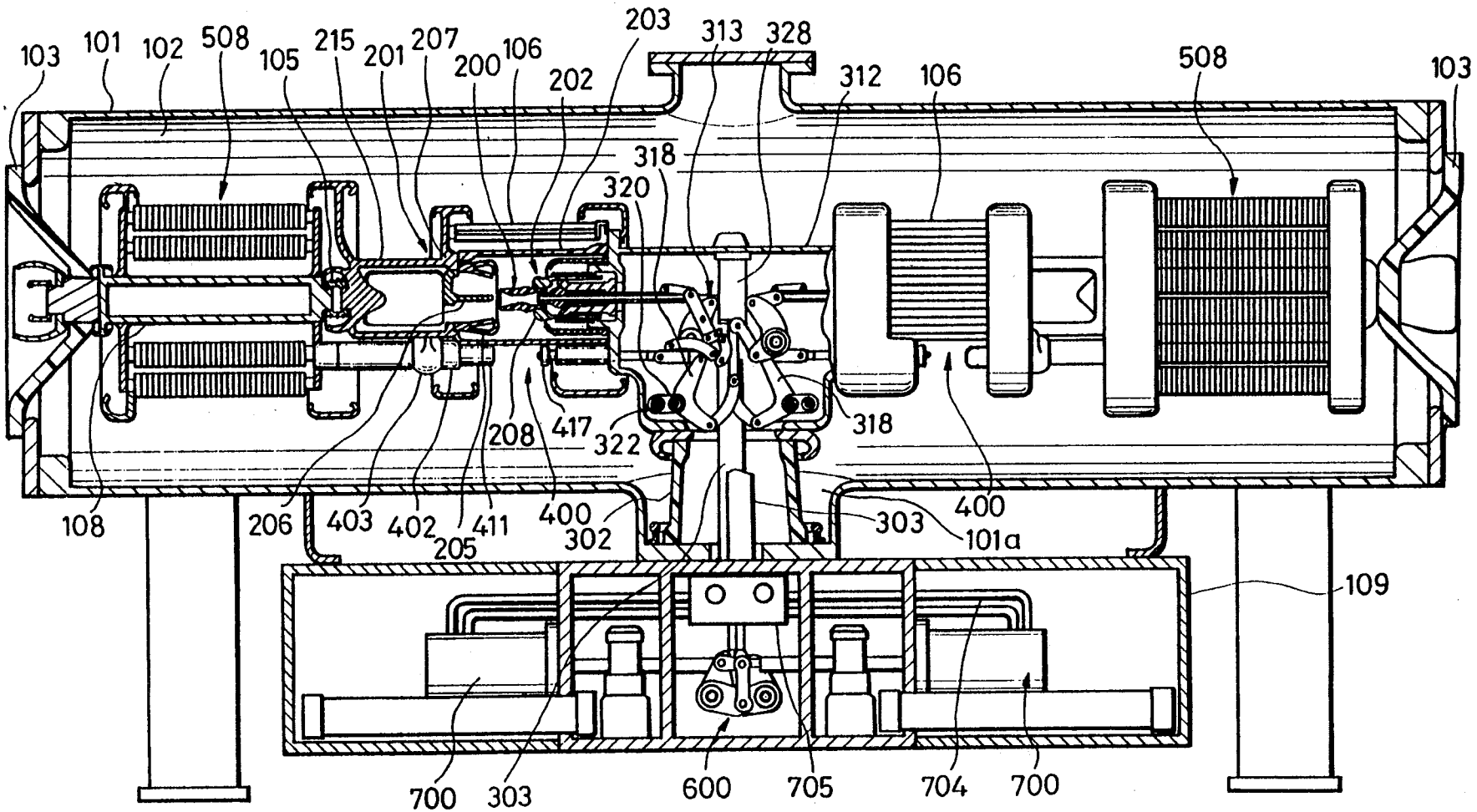
FIG. 1 is a sectional side view showing a constitution of a circuit breaker of a first embodiment in accordance with the present invention.
Figure 2:
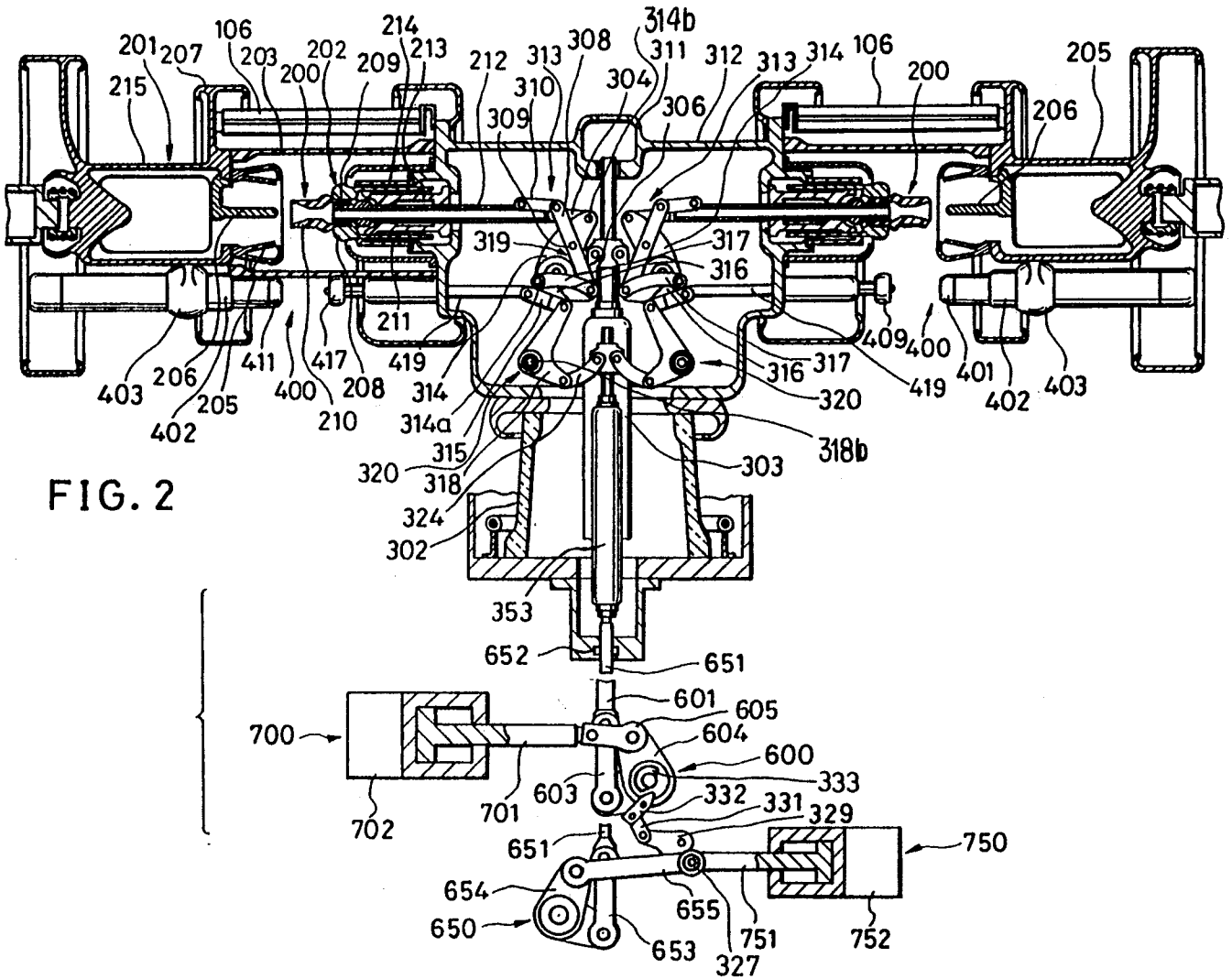
FIG. 2 is a sectional side view showing a detailed constitution and motion of a switching part of the circuit breaker shown in FIG. 1.
Figure 3:
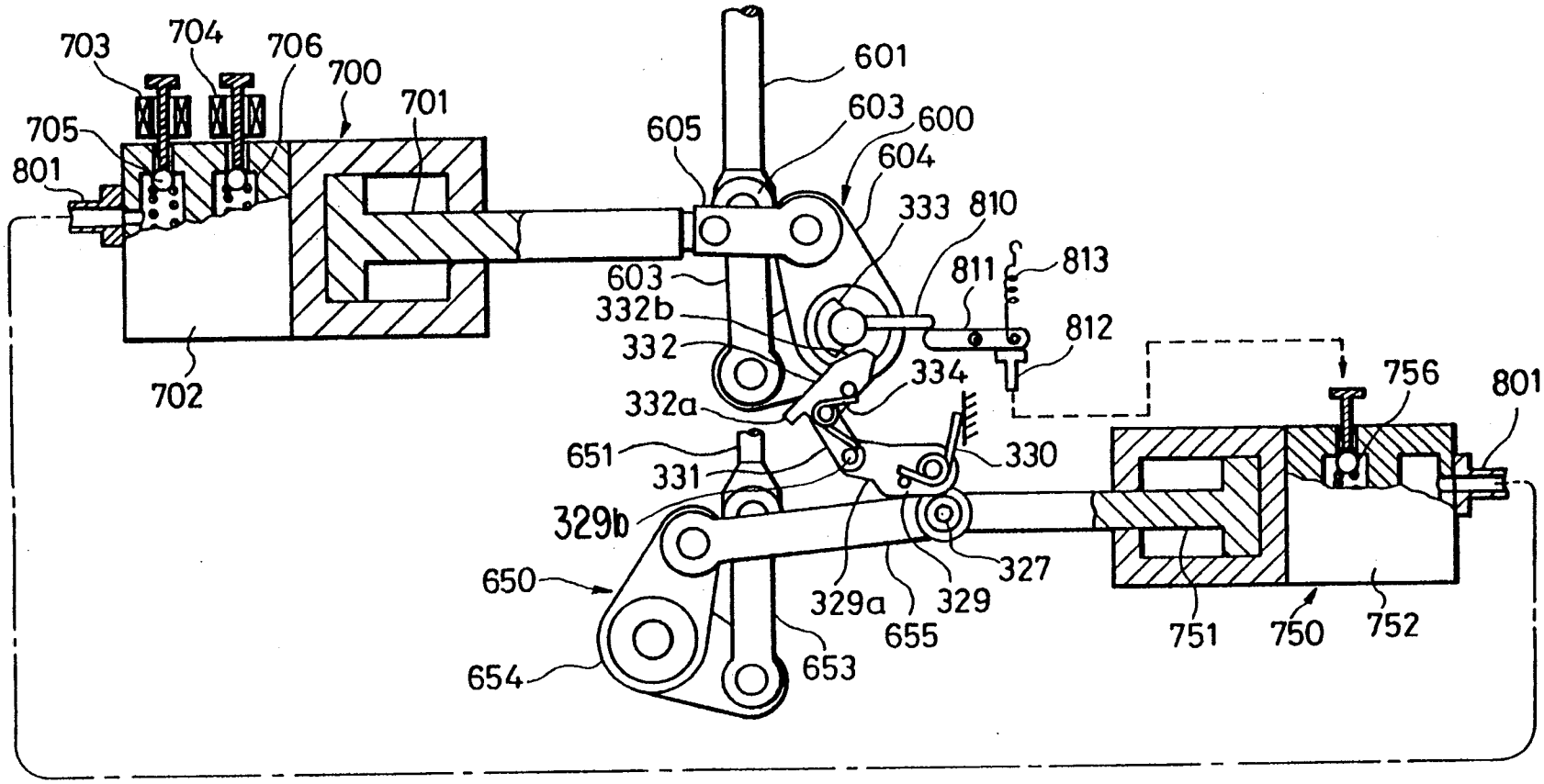
FIG. 3 is a sectional side view showing a detailed constitution and motion of a hydraulic operation system and third and fourth link mechanisms of the circuit breaker shown in FIG. 1.
Figure 4:
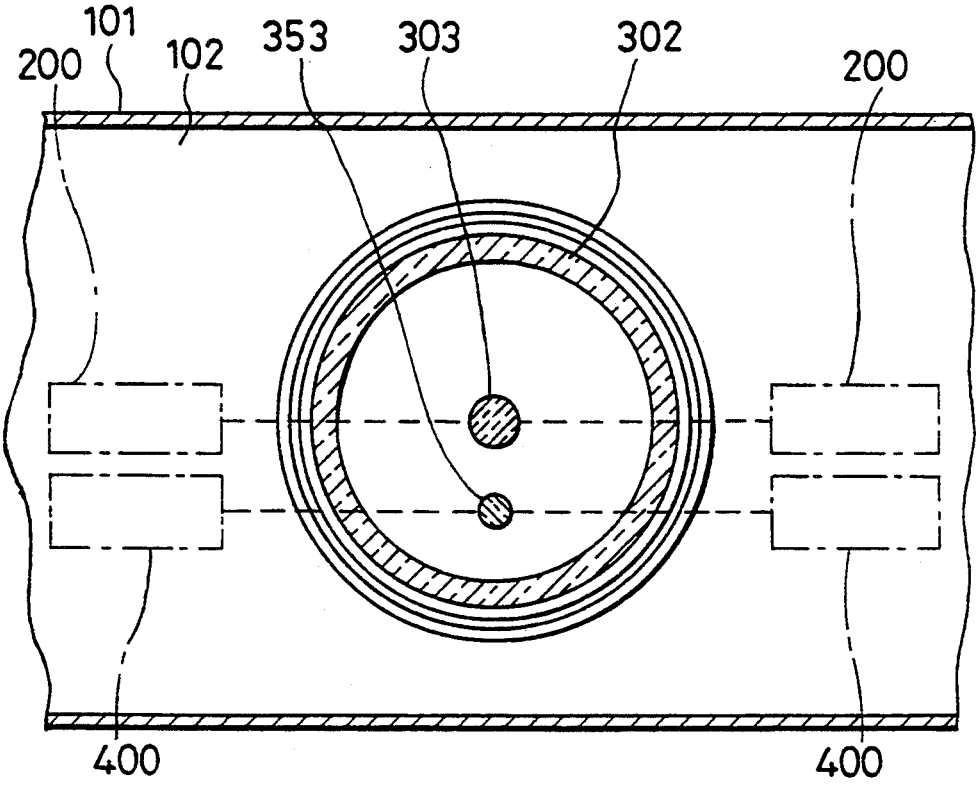
FIG. 4 is a sectional plan view showing the arrangement of insulated operation rods of the circuit breaker shown in FIG. 1.
Figure 5:
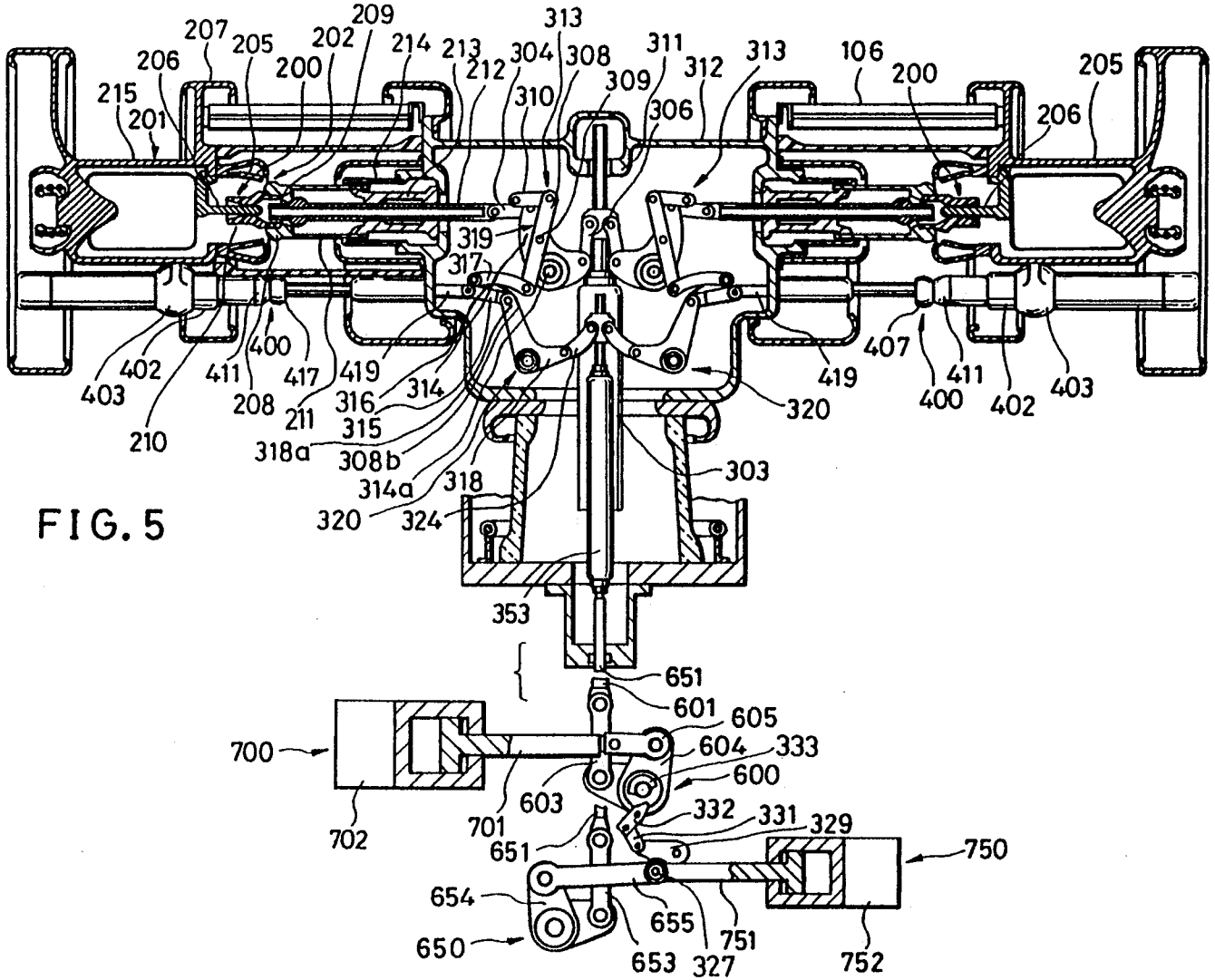
FIG. 5 is a sectional side view showing the detailed motion of the switching part of the circuit breaker shown in FIG. 2.
Figure 6:
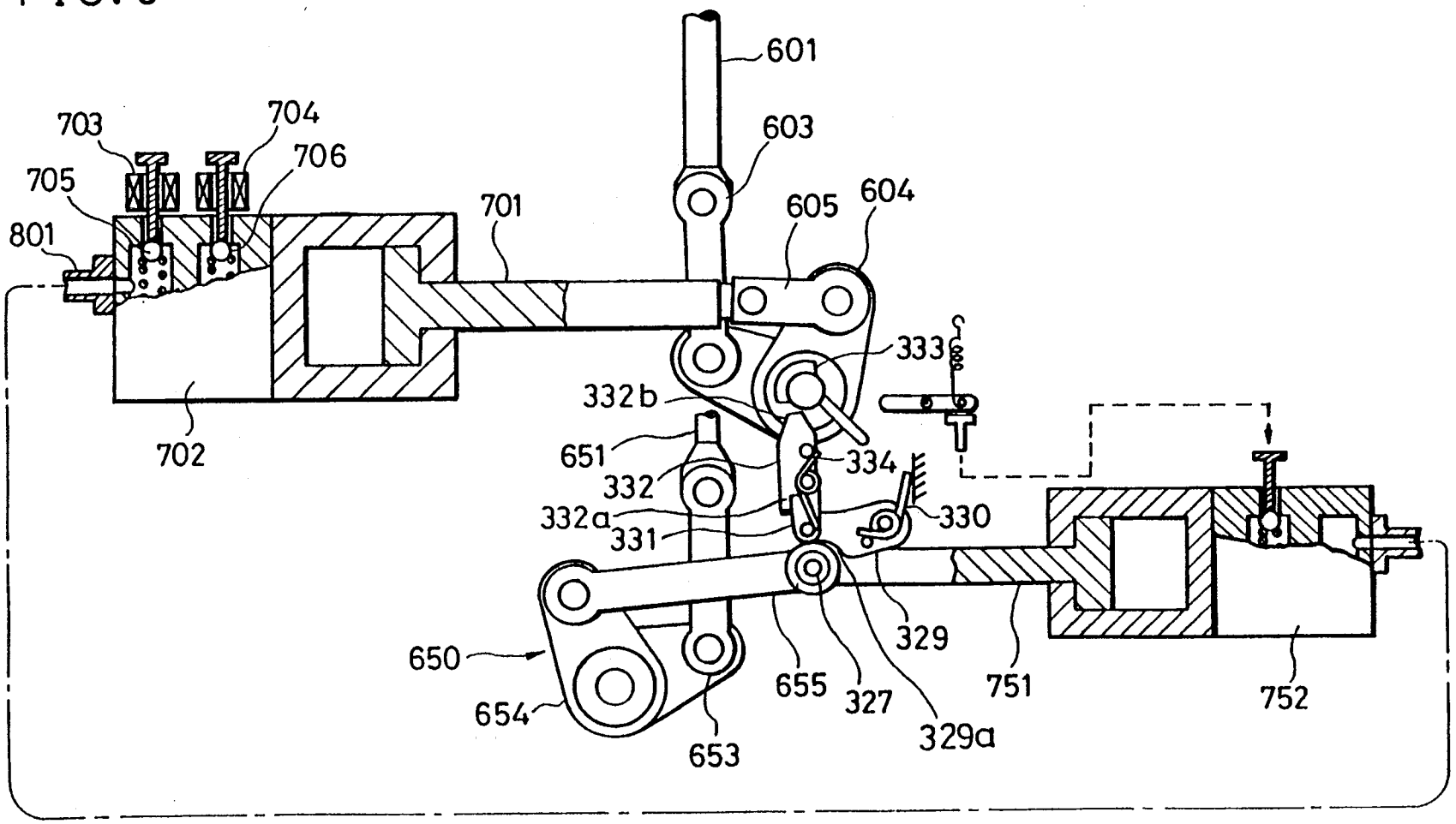
FIG. 6 is a sectional side view showing the detailed motion of the hydraulic operation system and third and fourth link mechanisms of the circuit breaker shown in FIG. 3.
Figure 7:
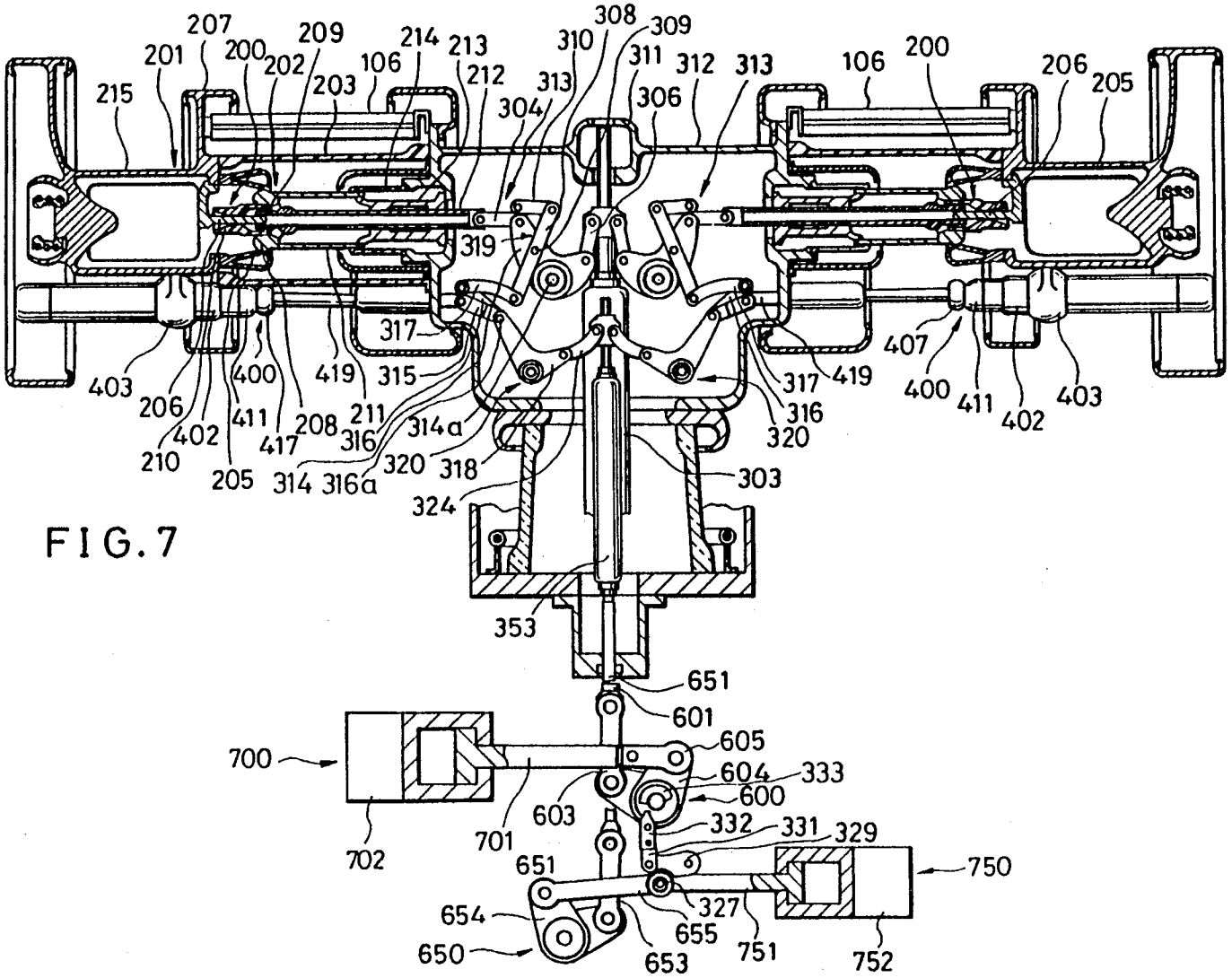
FIG. 7 is a sectional side view showing the detailed motion of the switching part of the circuit breaker shown in FIG. 2.

Hereafter, a first embodiment of a circuit breaker in accordance with the present invention is described concerning the accompanying drawings of FIGS. 1 to 12. FIG. 1 is a sectional side view of a constitution of the circuit breaker of the first embodiment. In FIG. 1, elements which are positioned in left-hand half part in the figure are further sectioned, and elements which are positioned in right-hand half part are not sectioned. The elements in left-hand half part and the elements in right-hand half part are substantially the same. FIGS. 2, 5, 7. 8, 10 and 11 are sectional side views respectively showing a detailed constitution and motion of a switching part of the circuit breaker shown in FIG. 1. FIGS. 3, 6, 9 and 12 are sectional side views respectively showing a detailed constitution and motion of a hydraulic operation apparatus of the circuit breaker.

In FIG. 1, an insulation gas in the space 102, such as $SF_6$ gas is filled in an inner space of a main tank 101. Both (right and left) main contacts 200 are held by a frame conductor 312 in the main tank 101. The frame conductor 312 is supported by an insulation holder 302 in a branch part 101*a* of the main tank 101. The (right and left) main contacts 200 are positioned In a manner that the center axis of the main contacts 200 is on the center axis of the main tank 101.

The following descriptions are mainly referring to the elements positioned in left-hand half part of FIG. 1, and the elements positioned in right-hand half part have substantially the same constructions and functions as those in the left-hand half part. Therefore, most of the descriptions of the elements in right-hand half part are omitted.

The main contact 200 consists of a stationary electrode 201 and a moving electrode 202, and these are mechanically connected by an insulation tube 203. A conductor 215 of the stationary electrode 201 serves as a cooling tube for cooling insulation gas which has been heated in an opening operation of the circuit breaker. Insulation spacers 103 are provided on both ends of the main tank 101 and connection conductors 108 are respectively held by the insulation spacers 103. Conductive connector 105 is provided between an end of the conductor 215 and the connection conductor 108 for electrically connecting them.

The above-mentioned insulation tube 203 is formed in a cylindrical shape. A number of capacitors 106 are provided around an outer periphery of the insulation tube 203, and terminals thereof are electrically connected in parallel with the main contact 200 to share the voltages of two main contacts 200 evenly.

On outer periphery of the connection conductor 108, plural resistors 508 are provided for restraining the surge when the circuit breaker is closed or broken. A resistor contact 400, which is provided electrically in series with the resistors 508, is positioned on the outer periphery of the insulation tube 203 and below the center axis of the main tank 101. The resistor contact 400 is electrically connected in parallel with the main contact 200. The center axes of the both resistor contacts 400 which are positioned in left-hand half part and right-hand half part in FIG. 1 are arranged on the same line which is parallel to the center axis of the main tank 101.

As shown in FIG. 2, the moving electrode 202 of the main contact 200 is coupled with a first insulated operation rod 303 via a first link mechanism 313 which is provided in the frame conductor 312. FIG. 4 is a sectional plan view showing arrangements of the first insulated operation rod 303 in the insulation holder 302 of the circuit breaker. As shown in FIG. 4, the first insulated operation rod 303 is arranged at a substantially vertical center axis of the insulation holder 302. The first insulated operation rod 303 is connected with a first hydraulic operation apparatus 700 via a third link mechanism 600 which is provided in the air. The first hydraulic operation apparatus 700, which is provided in an operation housing 109 as shown in FIG. 1, comprises a first hydraulic piston 701, a first hydraulic controller 702, an accumulator, an oil pump unit and so on.

On the other hand, as shown in FIGS. 1 and 2, the moving resistor contact 417 of the resistor contact 400 is coupled with a second insulated operation rod 353 via a second link mechanism 320 which is provided in the frame conductor 312. The second insulated operation rod 353 is eccentrically arranged in the insulation holder 302 as shown in FIG. 4. The second insulated operation rod 353 is connected with a second hydraulic operation apparatus 750 via a fourth link mechanism 650 which is provided in the air. The second hydraulic operation apparatus 750, which is provided in the operation housing 109 shown in FIG. 1, comprises a second hydraulic piston 751, a second hydraulic controller 752. an accumulator, an oil pump unit and so on, similarly to the construction as the above-mentioned first hydraulic operation apparatus 700.

As shown in FIG. 2, the stationary electrode 201 of the main contact 200 comprises a main stationary contact 205, a stationary arc contact 206, a shield 207 and a conductor 215. The moving electrode 202, which is arranged to face to the stationary electrode 201, comprises a main moving contact 208, a moving arc contact 209, a nozzle 210, a puffer cylinder 211, a piston 213 anti a finger contact 214.

In FIGS. 1 and 2, the stationary resistor contact 411, which is positioned below the center axis of the main tank 101, is slidably held by a resistor contact case 402. The resistor contact case 402 is fixed to the shield 207 via an insulation base 403. In a breaking state of the resistor contact 400, the stationary resistor contact 411 is pushed out by a pressing force of a restoration spring (not shown), which is disposed in the resistor contact case 402 because the resistor contact case 402 serves as a stopper. On an extension of the center axis of the stationary resistor contact 411, resistor elements of the resistors 508 are provided via a connector in a manner to be connected electrically in series to the stationary resistor contact 411. The moving resistor contact 417, which is positioned opposing to the stationary resistor contact 411, is movably held by the frame conductor 312 and electrically connected to the frame conductor 312 by a contact piece (not shown).

As shown in FIG. 2, a piston rod 212, which is connected to the piston 213 of the moving electrode 202, is coupled to a first lever 314 via a second link 304 of the first link mechanism 313. The first lever 314 is rotatably held by the frame conductor 312. Furthermore. the first lever 314 is coupled to the first insulated operation rod 303 via a first link 306 of the first link mechanism 313. A rod 419 is provided to contact with a bottom end of a third lever 308 via fourth link 315, sixth link 316 and fifth link 317. The third lever 308 is rotatably held by a pin 309 provided on the first lever 314. The pin 309 is arranged at a substantial center between the rotation center 314*a* of the first lever 314 and the coupling point 314*b* for connecting the second link 304 and the first lever 314. The third lever 308 is rotatably held by the seventh link 310 which is also rotatably held on the frame conductor 312. The third lever 308, the pin 309, the seventh link 310, sixth link 316 and fifth link 317 constitute a fifth link mechanism 319 which links the motion of the main contact 200 and the resistor contact 400.

On the other hand, the fourth link 315, which is connected to the rod 419 is coupled to the second lever 318 which is rotatably held at a rotation center 318*b* of the second lever 318 by the frame conductor 312.

The second levers 318, 318 (right and left) are symmetrically coupled to the second insulated operation rod 353 via fifth links 324, 324, respectively.

As shown in FIG. 2, the upper end of the first insulated operation rod 303 is guided by a guide 311 which is formed on the frame conductor 312. The lower end of the first insulated operation rod 303 is fixed to the first shaft 601 which is operated by the first hydraulic operation apparatus 700. The first shaft 601 penetrates the main tank 101 through a hermetic seal (not shown), and thereby the insulation gas in the space 102, such as $SF_6$ gas filled in the main tank 101, is gas-tightly sealed in the main tank 101. FIG. 3 is a side view showing the third link mechanism 600 which is coupled to the first shaft 601. In FIG. 3, the lower portion of the first shaft 601 disposed in the air is coupled to the first hydraulic piston 701 of the first hydraulic operation apparatus 700 via the third link mechanism 600 constituted by the eighth link 603, a fourth lever 604 and a first rod end 605. The fourth lever 604 is provided for changing the horizontal movement of the first hydraulic piston 701 into the vertical movement of the first shaft 601.

On the other hand, the upper end of the second insulated operation rod 353 is guided by a guide (not shown) which is formed on the frame conductor 312 by the same mechanism as the guide 311 for the first insulated operation rod 303 shown in FIG. 2. The lower end of the second insulated operation rod 353 is fixed to the second shaft 651 which is operated by the second hydraulic operation apparatus 750. The second insulated operation rod 353 is eccentrically positioned in the insulation holder 302 which dielectrically supports the frame conductor 312 as aforementioned in FIG. 4. In other words, the second insulated operation rod 353 is tandem arranged in parallel with the first insulated operation rod 303 located at a vertical center of the insulation holder 302. As shown in FIG. 2, the second shaft 651, which is connected to the second insulated operation rod 353, penetrates the main tank 101 through a hermetic seal 652, and thereby the insulation gas in the space 102, such as $SF_6$ gas filled in the main tank 101, is gas-tightly sealed in the main tank 101. As shown in FIG. 3, the lower portion of the second shaft 651 disposed in the air is coupled to the second hydraulic piston 751 of the second hydraulic operation apparatus 750 via the fourth link mechanism 650 constituted by a ninth link 653, a fifth lever 654 and a second rod end 655. The fifth lever 654 is provided for changing the horizontal movement of the second hydraulic piston 751 into the vertical movement of the second shaft 651.

The first hydraulic operation apparatus 700 and the second hydraulic operation apparatus 750 are arranged so as to be operated in reverse directions of the first hydraulic piston 701 and the second hydraulic piston 751 each other, and operating axes of them are arranged at different heights.

As shown in FIG. 3, a latch 329 is provided above the second rod end 655, which is coupled between the second hydraulic piston 751 and the fourth link mechanism 650. And the latch 329 is located in a space between the first hydraulic operation apparatus 700 and the second hydraulic operation apparatus 750, and is rotatably held on the operation housing 109. In the breaking state of the circuit breaker shown in FIG. 3, the latch 329 receives a rotation force in the counterclockwise direction by the restoration spring 330, and thereby, the latch 329 is contacting to the second rod end 655 in the breaking state. The latch 329 has a coupling part 329*a* to be engaged with a roller 327 when the aforementioned resistor contact 400 is in the closed state. An end 329*b* of the latch 329 is rotatably coupled to a seventh link 331. The seventh link 331 is rotatably coupled to a trigger 332. The trigger 332, which is rotatably held on the operation housing 109 at substantially center of the trigger 329, has a stopper part 332*a* and a contact part 332*b*. The stopper part 332*a* is formed on the lower end of the trigger 332, and the contact part 332*b* is formed on the upper end of it. The contact part 332*b* is pushed by a cam 333 at a final step of the opening operation of the main contact 200. The cam 333 is provided on the fourth lever 604 of the third link mechanism 600 for operating the resistor contact 400. Another restoration spring 334 is provided between the seventh link 331 and the trigger 332, so as to supply a force for making the stopper part 332*a* of the trigger 332 contact the seventh link 331 in every time.

In FIG. 3, the first hydraulic operation apparatus 700 comprises the first hydraulic piston 701 and the first hydraulic controller 702 having a closing electric magnet 703 and a breaking electric magnet 704. The closing electric magnet 703/or the breaking electric magnet 704 is excited by receiving a closing/or a breaking command from an external apparatus, and drives a closing hydraulic valve 705/or a breaking hydraulic valve 706 in response to the command, respectively. An amplifier (not shown) in the first hydraulic controller 702 amplifies the hydraulic signal from each hydraulic valve 705, 706 in order to control an oil pressure for operating the first hydraulic piston 701. Thereby, the first hydraulic piston 701 connected to the third link mechanism 600 is driven at a desired speed by the controlled oil pressure.

On the other hand, the second hydraulic operation apparatus 750 comprises the second hydraulic piston 751 and the second hydraulic controller 752. The second hydraulic controller 752 is provided to receive a hydraulic signal from the closing hydraulic valve 705 of the first hydraulic controller 702 through a hydraulic piping 801 when the first hydraulic controller 702 receives the closing command.

A rod 810 is provided on the fourth lever 604 of the link mechanism 600. A smaller lever 811, which is rotatably borne on the housing 107, contacts the rod 810. Thereby, the smaller lever 811 is rotated responding to the rotation of the fourth lever 604. A coil spring 813 is provided between an end of the smaller lever 811 and the housing 107 for supplying a rotation force to the smaller lever. An operation rod 812 is provided in a manner to convert the rotation of the smaller lever 811 to a displacement of the operation rod 812. The displacement of the operation rod 812 is transmitted to an opening valve 756 of the second hydraulic controller 752 via a mechanical transmitting means which is schematically shown by a dotted line in FIG. 3. Thereby, the opening valve 756 is controlled at a final stage of the opening operation of the main contact 200. When the opening valve is controlled to open, the oil pressure applied to the hydraulic piston 751 is amplified by a amplifier valve which is not shown in the figure for generating a driving force of the hydraulic piston 751.

Next,the operations of the circuit breaker configured as above in accordance with the present invention is described further referring to FIGS. 5 to 12. The operations of the switching parts provided in left-hand half part and right-hand half part are substantially the same. Thereby, the operation of the switching part left-hand half part only is described as representive, and that in right-hand half part is omitted.

In the breaking state of the circuit breaker shown in FIG. 2, the first hydraulic piston 701 of the first hydraulic operation apparatus 700 is pressed leftward and the first insulated operation rod 303 is disposed at the lowest position of the linear motion of it. The first lever 314, which is coupled to the first insulated operation rod 303 via the first link 306, is stopped at a position fully rotated clockwise. In such state, the main contact 200, which is coupled to the first lever 314 via the second link 304, is in the breaking state. The third lever 308, which is connected to the first lever 314, is stopped at a position fully rotated counterclockwise.

In FIG. 2, the second hydraulic piston 751 is pressed rightward and the second insulated operation rod 353 is disposed at the lowest position of the linear motion of it. The second lever 318, which is coupled to the second insulated operation rod 353 via the third link 324, is stopped at a position fully rotated clockwise. In such state, the resistor contact 400, which is coupled to the second lever 318 via the fourth link 315, is in the breaking state. In the above-mentioned breaking state shown in FIG. 2, the sixth link 316 and fifth link 317 are coupled between the second lever 318 and the third lever 308 in a manner to be folded. In the breaking state of the third link mechanism 600 and the fourth link mechanism 650 shown in FIG. 3, the latch 329 contacts the second rod end 655, and the seventh link 331 and the trigger 332 are folded as shown in FIG. 3.

When a closing command is issued from the external control apparatus (which is not shown in the figures), the closing electric magnet 703 of the first hydraulic controller 702 shown in FIG. 3 is operated, and thereby the closing hydraulic 705 is opened and the hydraulic signal of the first hydraulic controller 702 is transmitted to the second hydraulic controller 752 through the hydraulic piping 801. As a result, the first hydraulic piston 701 and the first rod end 605 are moved rightward in FIG. 3. When the first rod end 605 is moved rightward, the fourth lever 604 is rotated clockwise. Thereby, the first shaft 601 is moved upward via the eighth link 603. Furthermore, the first insulated operation rod 303, which is connected to the above-mentioned first shaft 601, is moved upward as shown in FIG. 5. The first lever 314, which is coupled with the first insulated operation rod 303 via the first link 306, is rotated in the counterclockwise direction. And the puffer cylinder 211 of the moving electrode 202 is driven so as to make the main contact 200 close by the movement of the first lever 314, via the second link 304 and the piston rod 212.

At the same time, the second hydraulic piston 751 and the second rod end 655 are moved in a leftward direction of FIG. 3. When the second rod end 655 is moved leftward, the fifth lever 654 is rotated in the counterclockwise direction. Thereby, the second shaft 651 is moved upward via the ninth link 653. Furthermore, the second insulated operation rod 353, which is connected to the above-mentioned second shaft 651, is moved upward as shown in FIG. 5. The second lever 318, which is coupled with the second insulated operation rod 353 via the third link 324, is rotated counterclockwise. And, the moving resistor contact 417 of the resistor contact 400 is moved to contact the stationary resistor contact 401 by the movement of the second lever 318 via the fourth link 315 and the rod 419.

On the other hand, the third lever 308, which is coupled to the first lever 314 by the pin 309, is rotated around the coupling point of the seventh link 310 and around the third lever 308 clockwise, by rotating the first lever 314 counterclockwise as shown in FIG. 5. The sixth link 316 and fifth link 317 move leftward in FIG. 5 with keeping the folded state and contacting the coupling point of them to the fourth link 315. Thereby, the driving force for closing the moving resistor contact 409 is transmitted via the rod 419.

The closing speed of the resistor contact 400 operated by the second hydraulic piston 751 is previously adjusted at the lower speed than the closing speed of the main contact 200 operated by the first hydraulic piston 701. As a result, in the above-mentioned closing operation of the resistor contact 400, the moving resistor contact 417 is moved to close the stationary resistor contact 411 with the closing operation of the main moving contact 208 in a manner that the roller **308*b* of the third lever 308 is kept to contact with the coupling point 318*a* of the second lever 318 and the fourth link 315**.

As shown in FIG. 5, at first, the moving resistor contact 417 contacts the stationary resistor contact 411 before the moving arc contact 209 contacts the stationary arc contact 206, and thereby only the resistor contact 400 is in a closed state. As a result, the resistors 508 is electrically connected in series with the resistor contact 400 for reducing the surge which occurs in the closing operation. Furthermore, the moving resistor contact 417 pushes the stationary resistor contact 411 in the resistor contact case 402 and compresses the restoration spring (not shown in the figure). Following to this operation, the moving arc contact 209 is closed to the stationary arc contact 206 and the main moving contact 208 is closed to the main stationary contact 205, sequentially.

When the stationary resistor contact 411 of the resistor contact 400 is pushed into the resistor contact case 402 by the moving resistor contact 417, the insulation gas ($SF_6$ gas) 102 in a space formed between a piston (not shown in the figure) and the stationary resistor contact 411 is compressed. When the compressed insulation gas in the space 102 is exhausted from orifices of the resistor contact case 402, the resistance force between the insulation gas in the space 102 and the orifices serves as a damping force.

FIG. 6 is a side view showing the third link mechanism 600 and the fourth link mechanism 650 of the circuit breaker in the closed state. As shown in FIG. 6, a roller 327, which is provided between the second hydraulic piston 751 and the second rod end 655, is moved leftward by the closing operation of the second hydraulic piston 751. When the roller 327 reaches the final position of the closing operation, the latch 329, which was slidably guided by the second rod end 655, is rotated thereby to engage with the roller 327 by the rotation force of the restoration spring 330 in the counterclockwise direction. The contact part **332*b* of the trigger 332 is released from the cam 333 owing to the rotation of the fourth lever 604 in a clockwise direction. Following the above-mentioned motions of the fourth lever 604, the trigger 332 and the seventh link 331, which is coupled to the latch 329, are extended straight by the force of the restoration spring 334, in such a manner that the stopper 332***a* of the trigger 332 contacts the seventh link 331.

FIG. 7 is a sectional side view showing the closed state of the switching part of the above-mentioned circuit breaker. When the first hydraulic piston 701 reaches the final position shown in FIG. 7, the closing operation of the circuit breaker has been completed. In the closed state shown in FIG. 6, the roller 327 is disposed so as to have a gap against the coupling part 329*a*.

Next, the opening operation of the circuit breaker is described. In the closed state of the circuit breaker shown in FIGS. 6 and 7, when a breaking command is issued from the external control apparatus (which is not shown in the figure), the breaking hydraulic valve 706 (FIG. 6) is opened by exciting the breaking electric magnet 704 of the first hydraulic controller 702. And an amplified hydraulic signal from the first hydraulic controller 702 is transmitted to the first hydraulic piston 701. As a result, the first hydraulic piston 701 and the first rod end 605 starts to move leftward of FIG. 6. The fourth lever 604 rotates counterclockwise, and the first shaft 601 is moved downward by the rotation of the fourth lever 604 via the eighth link 603. Furthermore, the first insulated operation rod 303 is also moved downward. In FIG. 7, the first lever 314, which is coupled to the first insulated operation rod 303 via the first link 306, is rotated clockwise. The puffer cylinder 211 of the moving electrode 202 slides toward the center of the frame conductor 312, being operated by the first lever 314 via the second link 304 and the piston rod 212.

Figure 8:
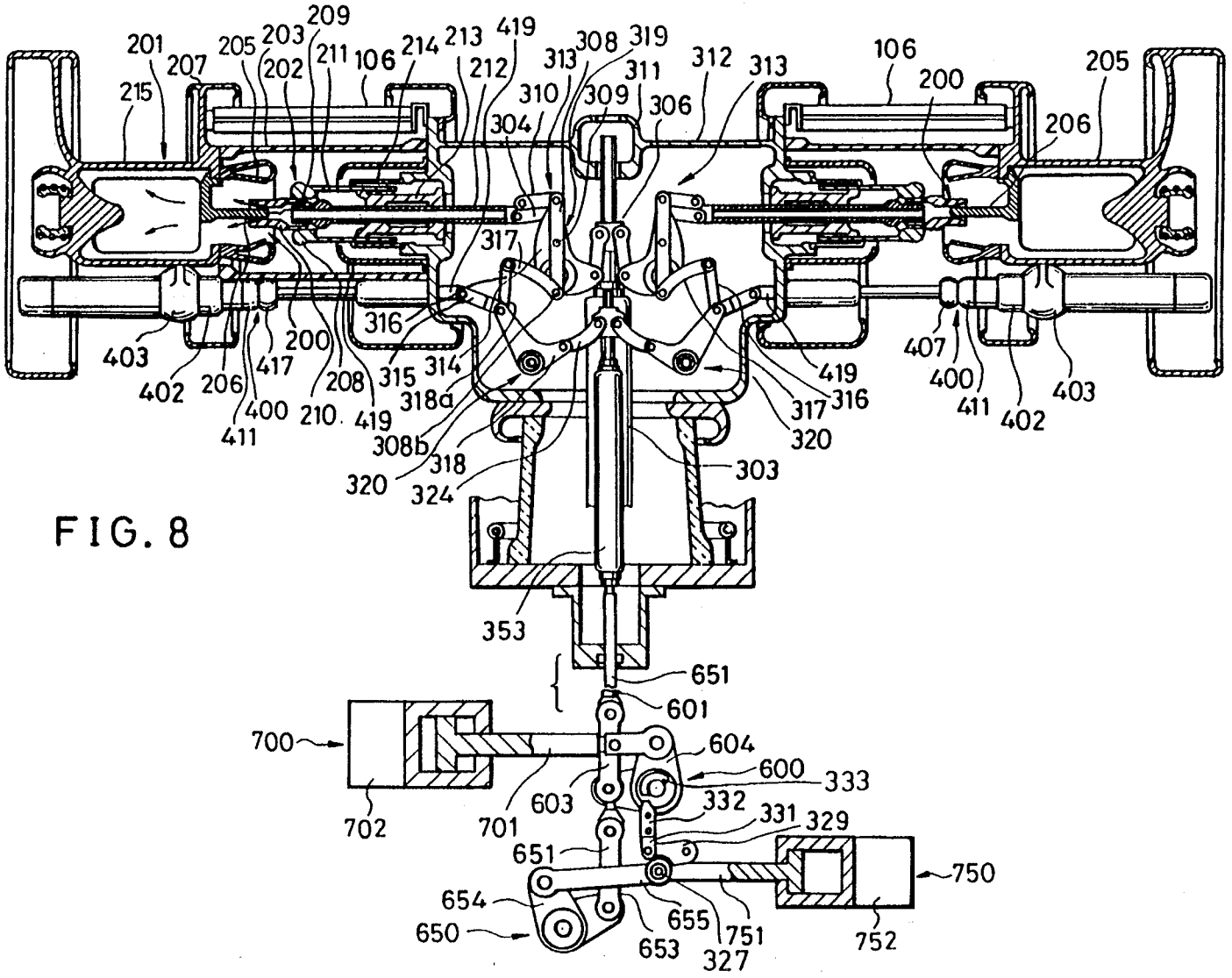
FIG. 8 is a sectional side view showing the detailed motion of the switching part of the circuit breaker shown in FIG. 2.

FIG. 8 is a side view showing of the circuit breaker during the opening operation. When the first lever 314 is rotated clockwise, the third lever 308, which is coupled to the first lever 314 by the pin 309, is rotated counterclockwise around the coupling point between the seventh link 310 and the third lever 308 as shown in FIG. 8. Thereby, the sixth link 316 and fifth link 317 move rightward in FIG. 8. Since the driving force for rotating the second lever 318 is kept by the second hydraulic piston 715, the second lever 318 can not rotate. Furthermore, the second lever 318 is coupled to the sixth link 316 and fifth link 317. And the moving resistor contact 417 is coupled to the sixth link 316 via the fourth link 315 and the rod 419. Therefore, the resistor contact 400 is kept to be in the closed state.

In FIG. 8, by the clockwise rotation of the first lever 314, the main moving contact 208 of the main contact 200 departs from the main stationary contact 205. After that, the moving arc contact 209 departs from the stationary arc contact 206. At the breaking time shown in FIG. 8, an arc occurs between the moving arc contact 209 and the stationary arc contact 206.

Since the coupling point 316*a* of the sixth link 316 and the second lever 318 is not movable, the sixth link 316 and fifth link 317 move with enlarging the angle between them by the rotation of the third lever 308 in counterclockwise direction in FIG. 7. Therefore, the resistor contact 400 is not opened, but the main contact 200 is opened. FIG. 8 shows the circuit breaker during the opening operation.

When the insulation gas in the space 102, which is compressed by the piston 213 and the puffer cylinder 211, blows the arc, the current flowing through the main contact 200 is cut off thereby, and a limited current flows through the resistor contact 400 and resistors 508. By using the resistors 508, an overvoltage at the breaking time is reduced to a desired voltage.

Figure 10:
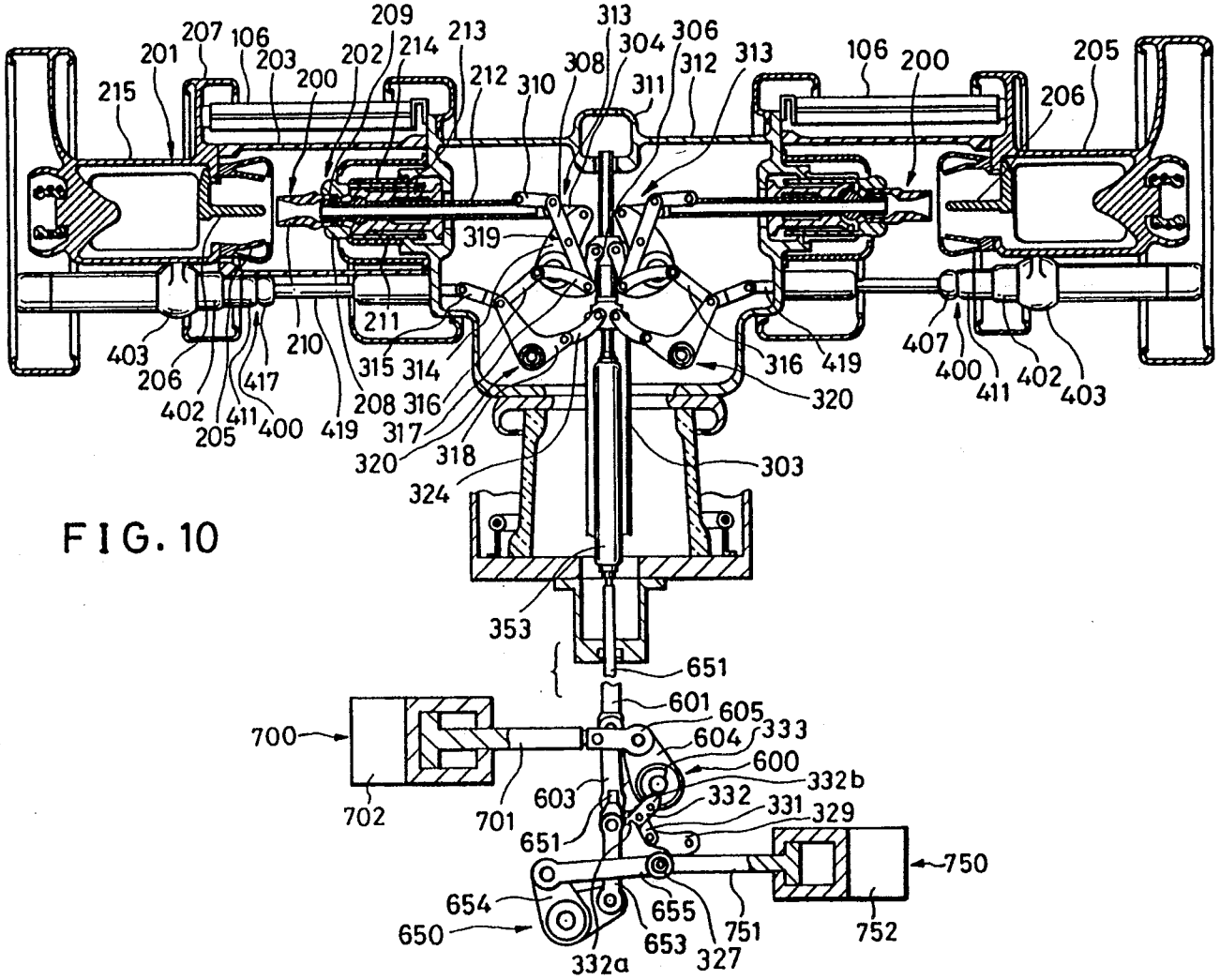
FIG. 10 is a sectional side view showing the detailed motion of the switching part of the circuit breaker shown in FIG. 2.

FIG. 10 is a sectional side view showing the switching part of the circuit breaker after the main contact has been opened but while the resistor contacts remain closed. In FIG. 10, when the first hydraulic piston 701 reaches the final breaking position, the opening operation for the main contact 200 has been completed. In the above-mentioned state shown in FIG. 10, the first lever 314 and the third lever 308 are disposed at the final breaking position. Thereby, the angle between the sixth link 316 and fifth link 317 becomes large.

Figure 9:
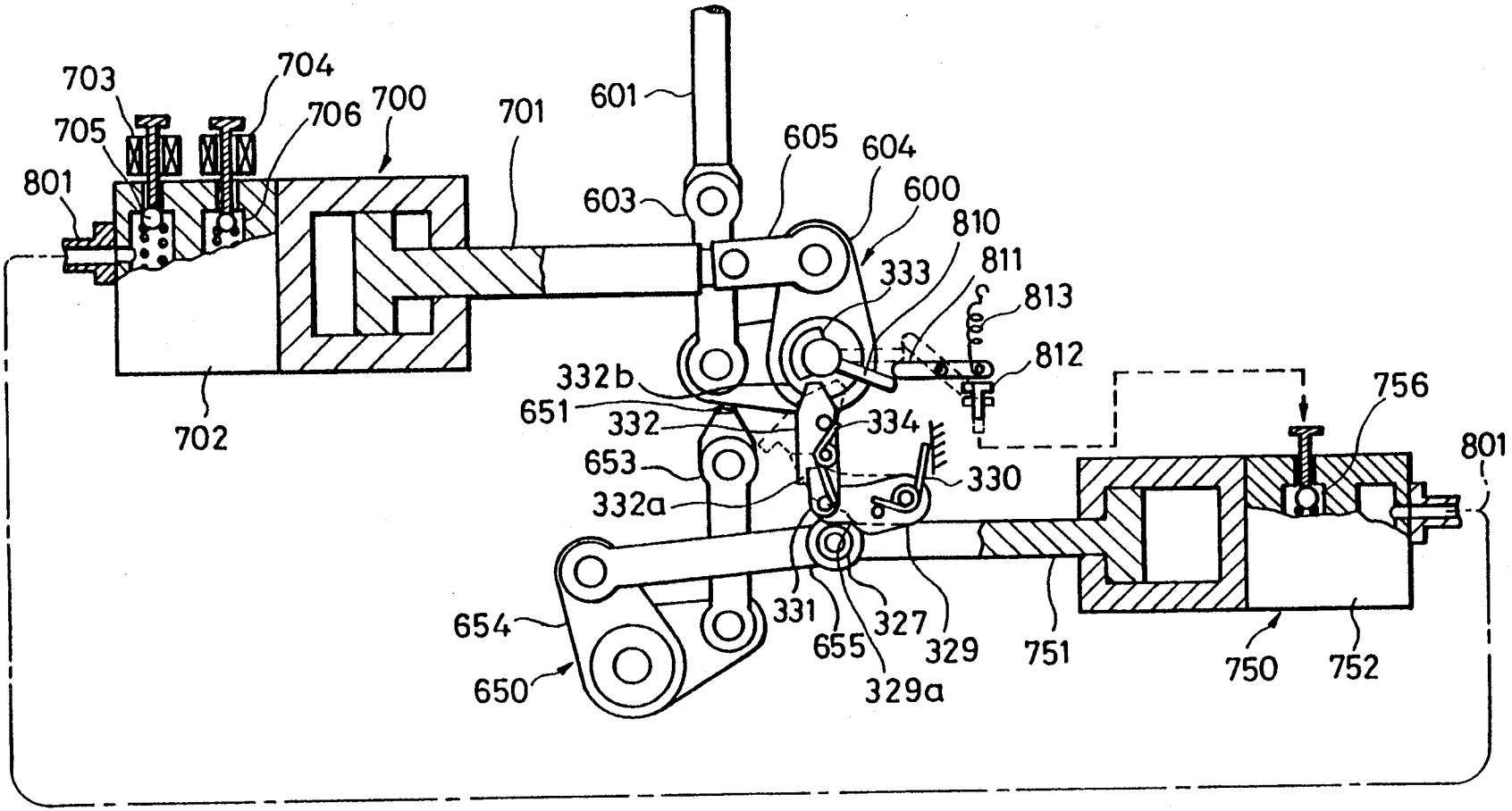
FIG. 9 is a sectional side view showing the detailed motion of the hydraulic operation system and third and fourth link mechanisms of the circuit breaker shown in FIG. 3.

When the fourth lever 604 operated by the first hydraulic piston 701 is further rotated counterclockwise beyond the position at the above-mentioned breaking time shown in FIG. 9 and approaches to the final position of the opening operation, the cam 333 on the fourth lever 604 pushes the contact part 332*b* of the trigger 332. And the trigger 332 starts to rotate in the clockwise direction as shown in FIG. 10. Therefore, the stopper part 332*a* of the trigger 332 departs from the seventh link 31, and the trigger 332 and the seventh link 331 are folded against the force of the restoration spring 334. As a result, the latch 329 is released from the restraint brought by the seventh link 331 and the trigger 332, and the latch 329 starts to rotate clockwise so as to release from the roller 327.

In the above-mentioned opening operation shown in FIG. 9, when the first hydraulic piston 701 of the first hydraulic operation apparatus 700 is moved leftward, and reaches the final breaking position as shown in FIG. 10, the rod 810 which is provided on the fourth lever 604 touches an end of the smaller lever 811. And thereby, the smaller lever 811 rotates in clockwise direction in FIG. 9, extending the coil spring 813. The other end of the smaller lever 811 pushes the operation rod 812. The motion of the operation rod 812 is transmitted to the opening valve 756 of the second hydraulic controller 752. As a result, the opening valve 756 is opened. When the opening valve 756 is opened, the oil pressure of the opening valve is amplified, and the amplified oil pressure is transmitted to the hydraulic piston 751.

When the fourth lever 604 further rotates, the rod 810 gets over the smaller lever 811. When the rod 810 departs from the smaller lever 811, the smaller lever 811 rotates in counterclockwise direction in FIG. 9 by the tension of the coil spring 813. Thereby, the operation rod 812 returns to the initial position as shown by the solid line thereof in FIG. 9.

Figure 11:
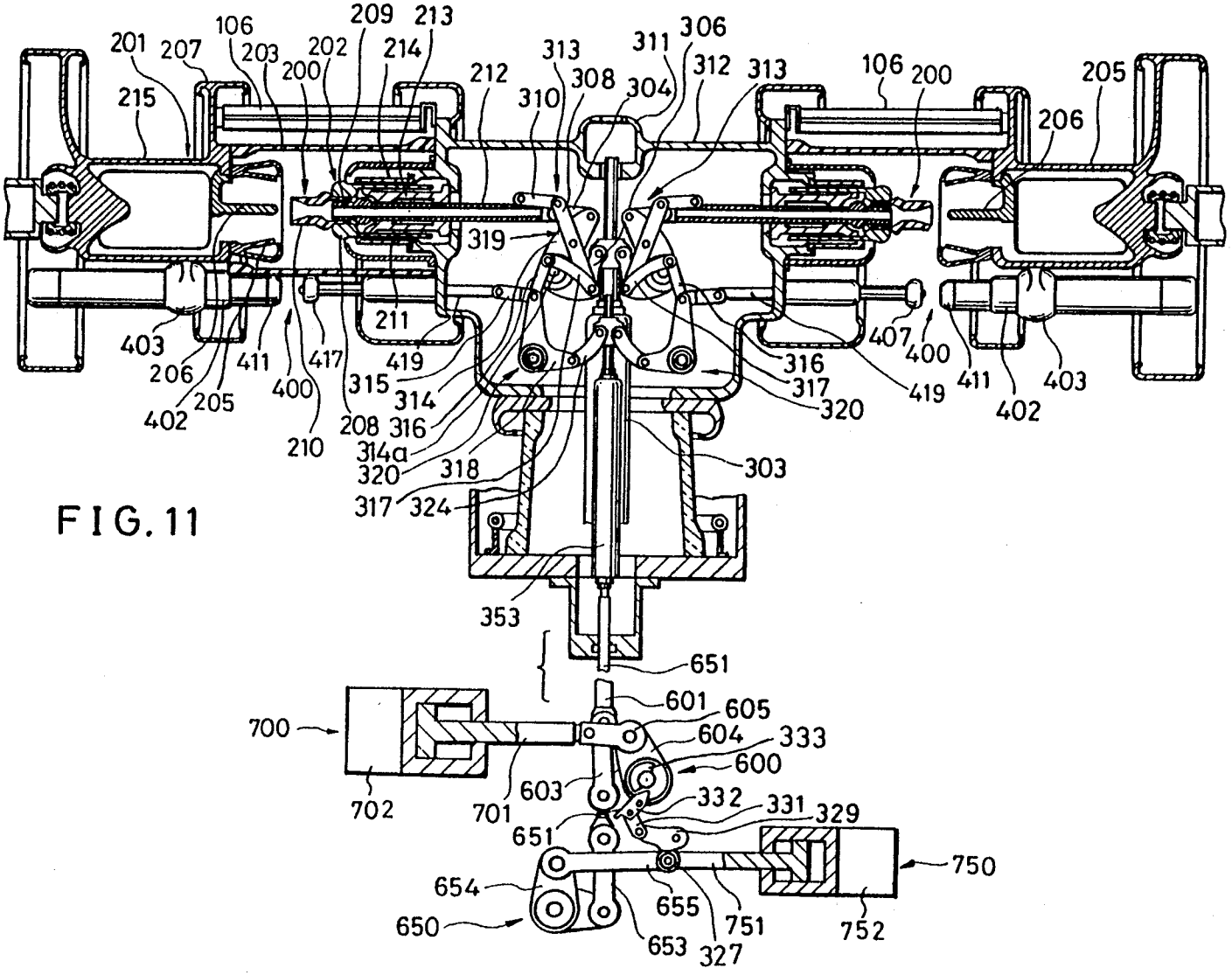
FIG. 11 is a sectional side view showing the derailed motion of the switching part of the circuit breaker shown in FIG. 2.

In the above-mentioned opening operation, the second hydraulic piston 751 and the second rod end 655 start to move rightward of FIG. 10. And the second shaft 651 is moved downward by the rotation of the fifth lever 654 in the clockwise direction via the ninth link 658. Furthermore, the second insulated operation rod 353, which is connected to the second shaft 651, is moved downward as shown in FIG. 11. FIG. 11 shows the switching part and the resistor contact 400 during the opening operation. The second lever 318, which is coupled with the second insulated operation rod 353 via the third link 324 is rotated clockwise. The moving resistor contact 417 of the resistor contact 400 is moved to the center of the Frame conductor 312 via the fourth link 315 and the rod 419.

When the second lever 318 is rotated in the clockwise direction in FIG. 11, the fifth link 317 moves to reduce the angle between the sixth link 816 and fifth link 317, since an end of the fifth link 317 is coupled to the third lever 308 which is stopped at this time.

After the above-mentioned opening operation shown by FIG. 11, the circuit breaker is in the initial state of the opened circuit breaker shown by FIGS. 2 and 3.

Next, an interlock mechanism of the above-mentioned circuit breaker in accordance with the present invention is described.

In the above-mentioned opening operation, the breaking speed of the main contact 200 and the resistor contact 400 must be set faster than the closing speed of them in order to secure necessary dielectric strength after current cut-off. Therefore, the drive unit which produces a large driving force for the main contact 200 and the resistor contact 400 must be provided in the circuit breaker. And, the circuit breaker needs the countermeasure for the malfunction owing to a mechanical shock or a vibration which is produced by such drive unit. The aforementioned circuit breaker of the present invention has the following interlock mechanism in order to prevent the malfunction.

In the closed state of the circuit breaker shown in FIG. 7, when a breaking command is issued from the external control apparatus (which is not shown in the figure), the first hydraulic piston 701 starts so as to break the main contact 200. Let us suppose that in the way of the opening operation of the main contact 200, the second hydraulic controller 752 of the second hydraulic operation apparatus 750 has been operated in malfunction caused by a shock or a vibration or the like of the first hydraulic piston 701, and the second hydraulic piston 751 receives a driving force rightward in FIG. 7.

Figure 12:
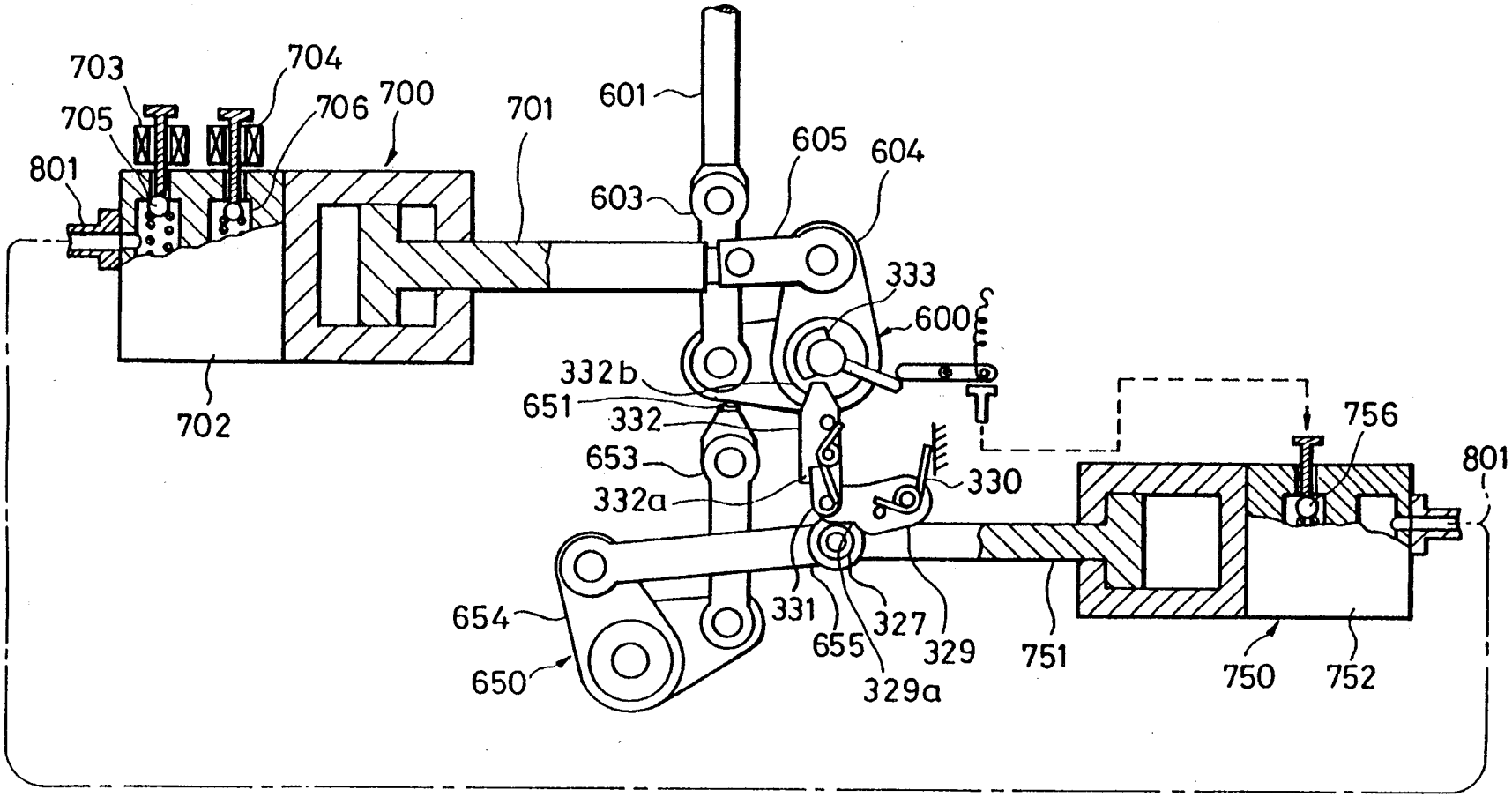
FIG. 12 is a sectional side view showing the detailed motion of the hydraulic operation system and third and fourth link mechanisms of the circuit breaker shown in FIG. 3.

Then, the second hydraulic piston 751 starts to further move rightward. FIG. 12 shows the above-mentioned state that the second hydraulic piston 751 is operated in the malfunction. In the above-mentioned malfunction of the second hydraulic piston 751, the second hydraulic piston 751 and the second rod end 655 start to move rightward. When the second hydraulic piston 751 and the second rod end 655 is moved for a very short interval, the roller 327 abuts to the coupling part 329*a* of the latch 329. Therefore, the latch 329 receives a revolution force in the clockwise direction against the force of the restoration spring 330, and the seventh link 331 receives a lifting force in an upward direction. As a result, though the trigger 332 receives a revolution force in the counterclockwise direction, the trigger 332 is prevented to rotate by contacting between the stopper 332*a* of the trigger 332 and the seventh link 331.

By the above-mentioned engagement between the roller 327 and the coupling part 329*a* of the latch 329, the second lever 318, the fourth link 315, the rod 419 and the moving resistor contact 417, which are mechanically connected to the second hydraulic piston 751, are prevented their malfunctional motion owing to a shock, a vibration or the like. As a result, the resistor contact 400 is kept safely in the closed state even if the second hydraulic operation apparatus 750 is in malfunction.

When the main contact 200 approaches the final step of the opening operation, the cam 333, which is provided on the fourth lever 604, pushes the contact part 332*b* of the trigger 332, and thereby, the trigger 332 is rotated clockwise as shown in FIG. 10. As a result, the stopper part 332*a* of the trigger 332 departs from the seventh link 331, and the trigger 332 and the seventh link 331 are folded against the force of the restoration spring 334. Therefore, the latch 329 is released from the restraint of the seventh link 331 and the latch 329 starts clockwise rotation. And the engagement of the latch 329 and the roller 327 is also released. Since the roller becomes free from the restraint of the latch 329, the second hydraulic piston 751 and the second rod end 655 start to move rightward, thereby to break the resistor contact 400 by the driving force of the second hydraulic operation apparatus 750. Then, the fifth lever 634 rotates clockwise, and the second shaft 651 is moved downward by the rotation of the fifth lever 654 via the ninth link 653. And, the second insulated operation rod 353 is also moved downward. As a result, the second lever 318, which is coupled to the second insulated operation rod 353 via the third link 324, is rotated clockwise as shown in FIG. 11. The moving resistor contact 417 of the resistor contact 400 is moved toward the center of the frame conductor 312 by the rotation of the second lever 318 via the fourth link 315 and rod 419.

As the interlock mechanism is constructed by the above-mentioned mechanism, the breaking timing between main contact 200 and the resistor contact 400 is kept at a constant even if the mechanical shocks or the vibration occurs in the opening operation.

On the other hand, in the closing operation of the circuit breaker, the first hydraulic piston 701 and the second hydraulic piston 751 start to move in a closing direction at the same time when a closing command is received. The resistor contact 400 operated by the second hydraulic piston 751 is driven to be closed at a lower speed than the closing speed of the main contact 200 operated by the first hydraulic piston 701. Therefore, in the closing operation, the roller 308*b* of the third lever 308 keeps to touch with the coupling point 318*a* between the fourth lever 315 and the second lever 318. In the such state, the moving resistor contact 417 is moved leftward to approach to the stationary resistor contact 411 at the same speed as the main contact 200. As a result, the closing timing between the resistor contact 400 and the main contact 200 is kept at a constant in the closing operation.

Second Embodiment

Figure 13:
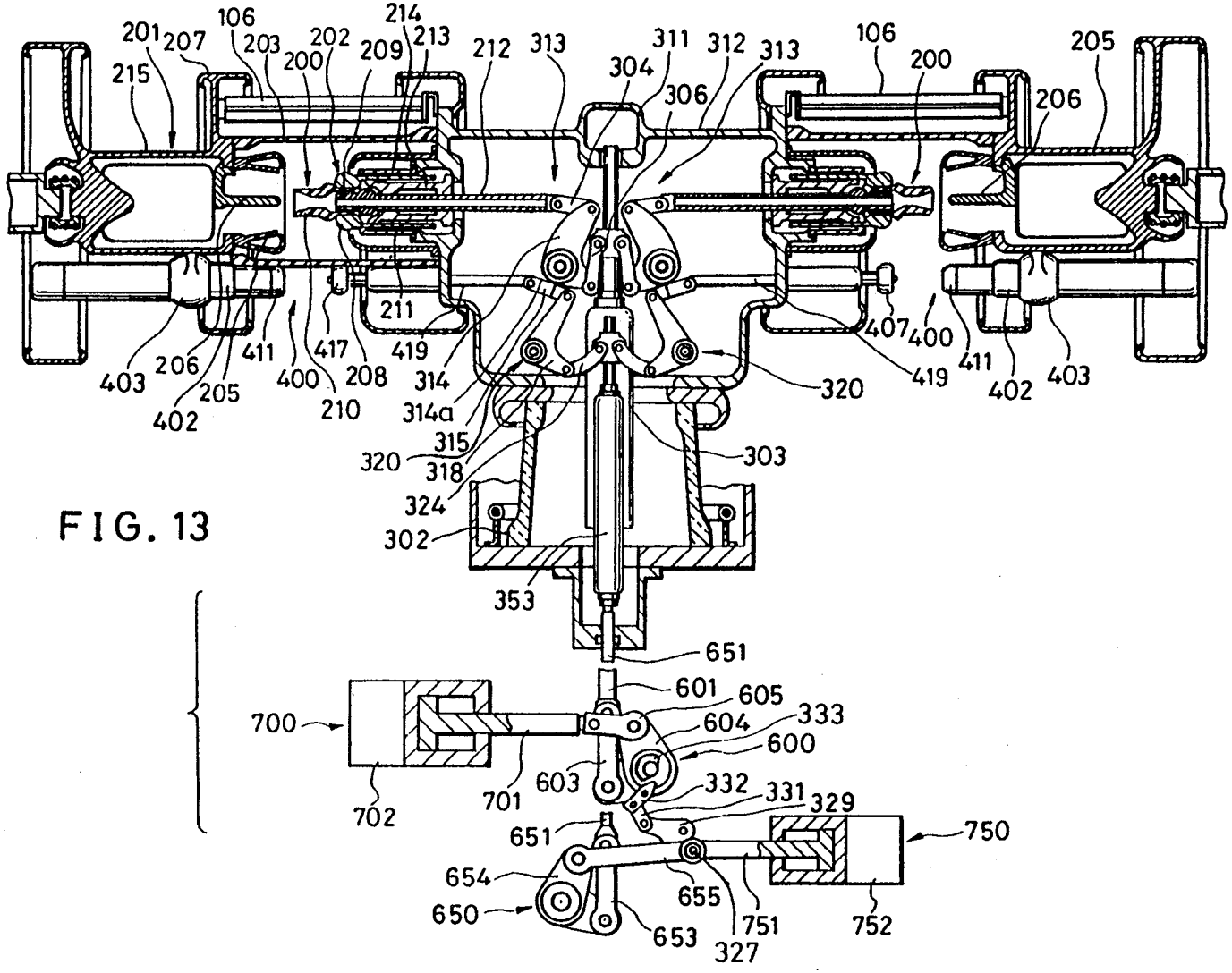
FIG. 13 is a sectional side view showing detailed constitution and motion of a switching part of a circuit breaker of a second embodiment in accordance with the present invention.

Hereafter, a second embodiment of a circuit breaker in accordance with the present invention is described referring to FIG. 13. FIG. 13 is a sectional side view of a circuit breaker of the second embodiment in accordance with the present invention. Elements designated by the same numerals in the second embodiment as those of the first embodiment are substantially the same. Thereby, the explanation of them are omitted.

In the circuit breaker of the afore-mentioned first embodiment, for example, shown in FIG. 2, the rod 419 of the moving resister contact 409 is coupled to an end of the third lever 308 via the fourth link 315, sixth link 316 and fifth link 317. In FIG. 2, the sixth link 316 and fifth link 317 are folded. And the third lever 308 is rotatably pivoted at substantially the center thereof by the pin 309. The pin 309 is provided substantially the center between the rotation center of the first lever 314 and the coupling point of the first link and the third lever 308. The other end of the third lever 308 is rotatably pivoted on the seventh link 310 which is rotatably pivoted on the frame conductor 312.

In the second embodiment shown in FIG. 13, the sixth link 316 and fifth link 317, the third lever 308, the pin 309 and the seventh link 310 which constitute the fifth link mechanism for linking the first and second link mechanisms in the first embodiment are omitted.

The motion of the circuit breaker in the second embodiment shown in FIG. 13 is briefly described. The operations of the switching parts provided in left-hand half part and right-hand half part are substantially the same. Thereby, the operation of the switching part in left-hand half part only is described as representive, and that in right-hand half part is omitted.

In the closing operation of the circuit breaker, when an electric closing command is issued, the hydraulic piston 701 of the first hydraulic operation apparatus 700 starts to move rightward in FIG. 13, and the hydraulic piston 751 of the second hydraulic operation apparatus 750 starts to move in leftward in FIG. 13. Following to the motion of the first and second hydraulic operation apparatuses 700 and 750, the first and second insulated operation rods 303 and 353 are moved upward, and the first and second levers 314 and 318 are respectively rotated in counterclockwise direction in FIG. 13. The main moving contact 208 and the moving resistor contact 409 are respectively driven leftward to be closed. Timings when the main contact 200 and the resistor contact 400 are closed are defined by the power of the first and second hydraulic operation apparatuses 700 and 750. On the other hand, the opening operation of the circuit breaker is substantially the same as that in the first embodiment.

In the closing operation of the first embodiment, the main contact 200 and the resistor contact 400 are driven in substantially the same speed. The resistor contact 400 is closed prior to the closing of the main contact 200. And the closing timings of the main contact 200 and the resister contact 400 are kept to be constant.

However, in the second embodiment, the closing timings of the main contact 200 and the resistor contact 400 are freely selectable by adjusting the driving forces of the first and second hydraulic operation apparatuses 700 and 750. Furthermore, the total size of the circuit breaker in the second embodiment can be downsized, since the parts for constituting the fifth link mechanisms are omitted.

Third Embodiment

Figure 14:
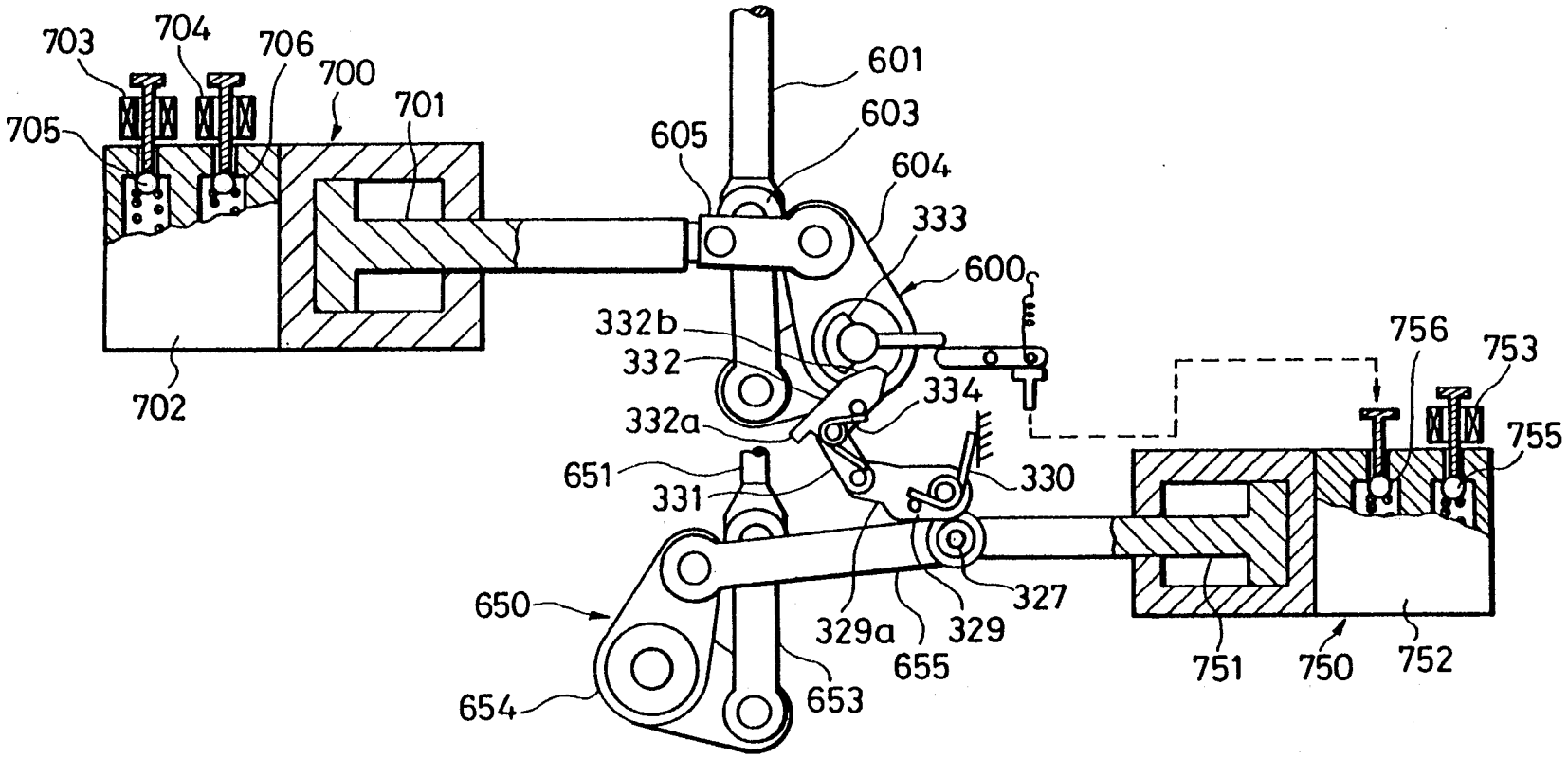
FIG. 14 is a sectional side view of a hydraulic operation system of the circuit breaker of the third embodiment in accordance with the present invention.

Hereafter, a third embodiment of a circuit breaker in accordance with the present invention is described referring to FIG. 14. FIG. 14 is a sectional side view of a hydraulic operation system of the circuit breaker of the third embodiment in accordance with the present invention. Elements designated by the same numerals in the third embodiment as those of the first embodiment are substantially the same. Thereby, the explanation of them are omitted.

In the closing operation of the circuit breaker in the first embodiment, the electric closing command signal to the closing electro-magnet 703 of the hydraulic controller 702 in the first hydraulic operation apparatus 700 is converted to the hydraulic signal as shown in FIG. 3. And the hydraulic signal is transmitted to the second hydraulic operation apparatus 750 via the pipe line 801 at the same time.

On the other hand, in the third embodiment shown in FIG. 14, a closing electro-magnet 753 and a closing valve 755 are provided on the hydraulic controller 752 of the second hydraulic operation apparatus 750. The electric closing command signal is applied to the closing electro-magnets 703 and 753 at the same time.

By such a configuration shown in FIG. 14, even when the closing electro-magnets 703 and 753 are placed Far away, the arrangement of the parts which constitute the first and second hydraulic operation apparatuses 700 and 750 become easy, since the pipe line 801 shown in FIG. 3 is omitted.

Fourth Embodiment

Figure 15:
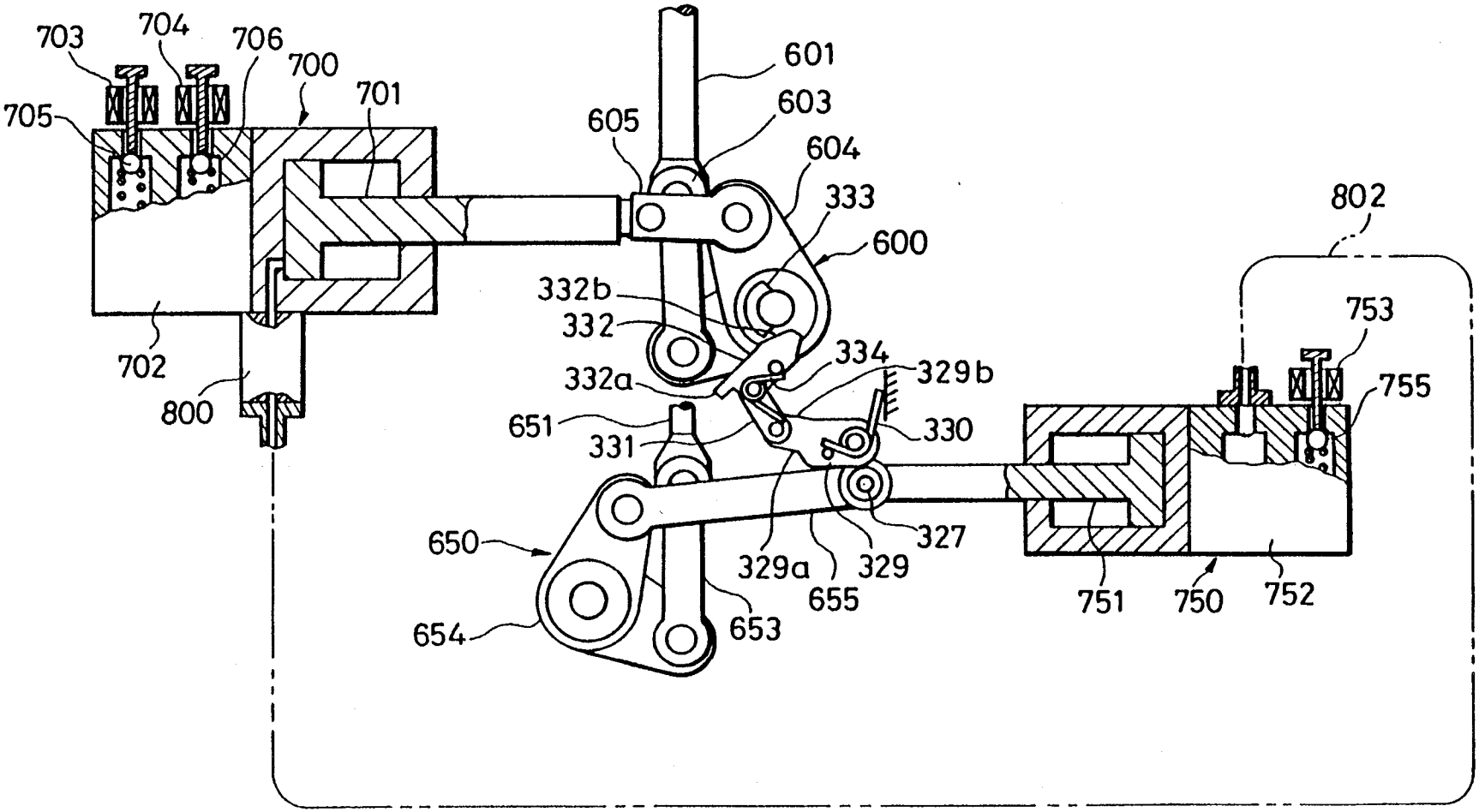
FIG. 15 is a sectional side view of a hydraulic operation system of the circuit breaker of the fourth embodiment in accordance with the present invention.

Hereafter, a fourth embodiment of a circuit breaker in accordance with the present invention is described referring to FIG. 15. FIG. 15 is a sectional side view of a hydraulic operation system of the circuit breaker of the fourth embodiment in accordance with the present invention. Elements designated by the same numerals in the fourth embodiment as those of the first embodiment are substantially the same. Thereby, the explanation of them are omitted.

In the opening operation in the first embodiment, when the fourth lever 604 is rotated in counterclockwise direction in FIG. 3 in the final step of the opening operation after the main contact 200 shown in FIG. 2 is opened, the rod 810 touches the end of the smaller lever 811. Thereby, the smaller lever 811 is rotated in clockwise direction in FIG. 3. The other end of the smaller lever 811 pushes the operation rod 812. The displacement of the operation rod 812 is mechanically transmitted to the opening valve 756 of the hydraulic controller 752. As a result, the opening valve 756 is opened, and the oil pressure of the opening valve 756 is amplified and transmitted to the hydraulic piston 751.

On the other hand, in the fourth embodiment, a limit position detector 800 is provided in the first hydraulic operation apparatus 700 for detecting that the hydraulic piston 701 reaches to the limit position in the opening operation of the circuit breaker. When the limit position detector 800 detects the reach of the hydraulic piston 701, the limit position detector 800 outputs a hydraulic signal to the hydraulic controller 752 of the second hydraulic operation apparatus 750 via a pipe line 802. Thereby, the second hydraulic operation apparatus 750 drives the resistor contact 400 for opening. The closing operation in the fourth embodiment is substantially the same as that in the third embodiment, and thereby the explanation of the closing operation is omitted.

In the fourth embodiment configured above, the completion of the opening operation of the main contact 200 is detected by the limit position detector 800, and the second hydraulic operation apparatus 750 for driving the resistor contact 400 is controlled by the hydraulic signal from the limit position detector 800. Therefore, the time period which is necessary to opening and closing the circuit breaker becomes stable. Furthermore, in comparison with the case of using a mechanical position detector, the opening operation becomes reliable, since loss of the hydraulic control is much smaller than that of the mechanical control.

Fifth Embodiment

Figure 16:
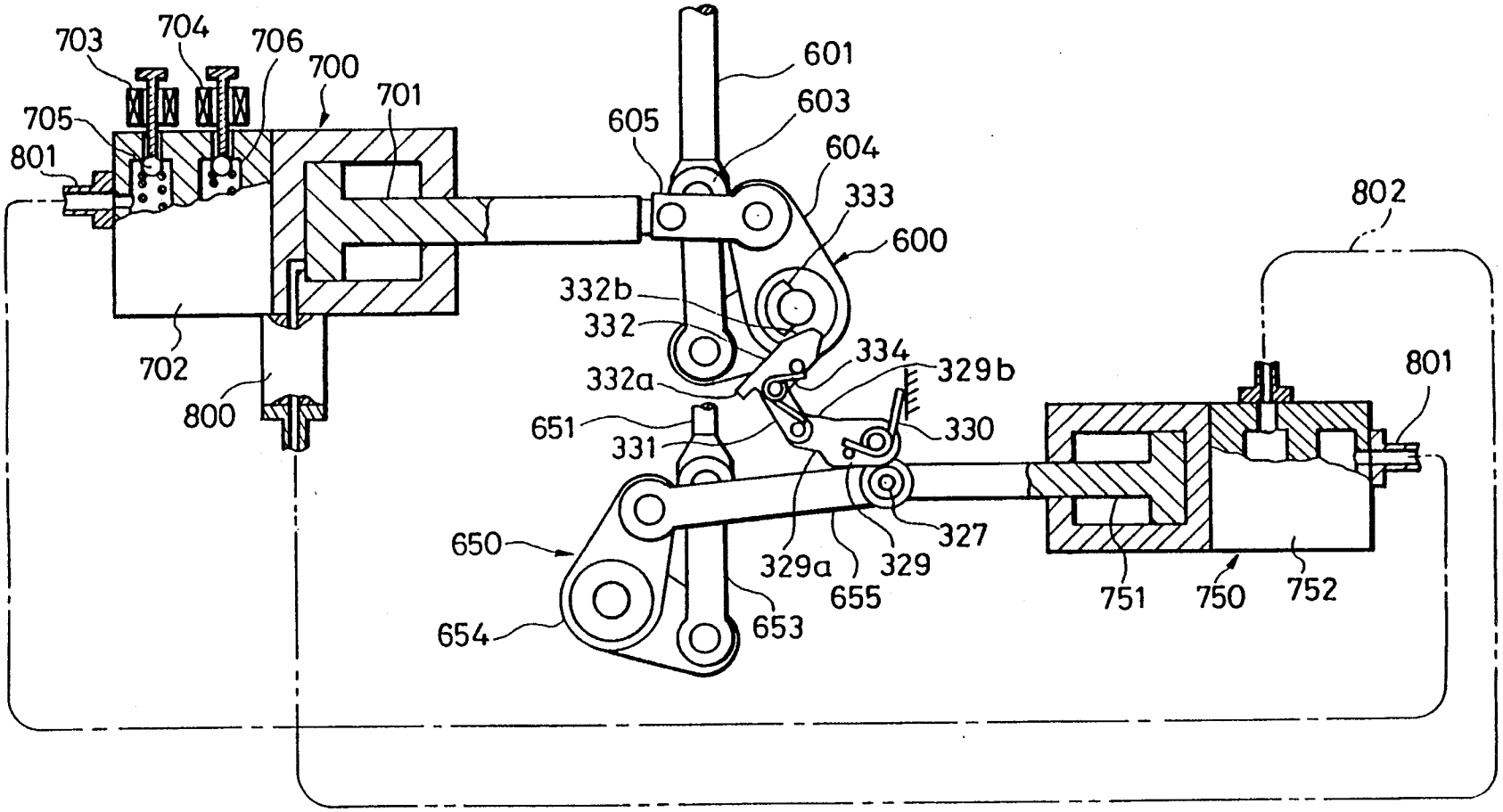
FIG. 16 is a sectional side view of a hydraulic operation system of the circuit breaker of the fifth embodiment in accordance with the present invention.

Hereafter, a fifth embodiment of a circuit breaker in accordance with the present invention is described referring to FIG. 16. FIG. 16 is a sectional side view of a hydraulic operation system of the circuit breaker of the fifth embodiment in accordance with the present invention. Elements designated by the same numerals in the fifth embodiment as those of the first embodiment are substantially the same. Thereby, the explanation of them are omitted.

In the fifth embodiment, for closing the circuit breaker, the electric closing command signal to the closing electro-magnet 703 of the hydraulic controller 702 in the first hydraulic operation apparatus 700 is converted to the hydraulic signal. And the hydraulic signal is transmitted to the second hydraulic operation apparatus 750 at the same time. Such a constitution is the same as that in the afore-mentioned first embodiment.

Furthermore, for opening the circuit breaker, the reach of the hydraulic piston 701 to the limit position is detected by the limit position detector 800. When the limit position detector 800 detects the reach of the hydraulic piston 701, the limit position detector 800 outputs a hydraulic signal to the hydraulic controller 752 of the second hydraulic operation apparatus 750 via a pipe line 802. Thereby, the second hydraulic operation apparatus 750 drives the resistor contact 400 for opening. Such a opening operation in the fifth embodiment is the same as that in the fourth embodiment.

In the fifth embodiment configured above, the second hydraulic operation apparatus 750 is controlled by the hydraulic signal for opening and closing the resister contact 400. Therefore, the time period which is necessary to opening and closing the circuit breaker becomes stable. And the opening operation becomes reliable.

Sixth Embodiment

Figure 17:
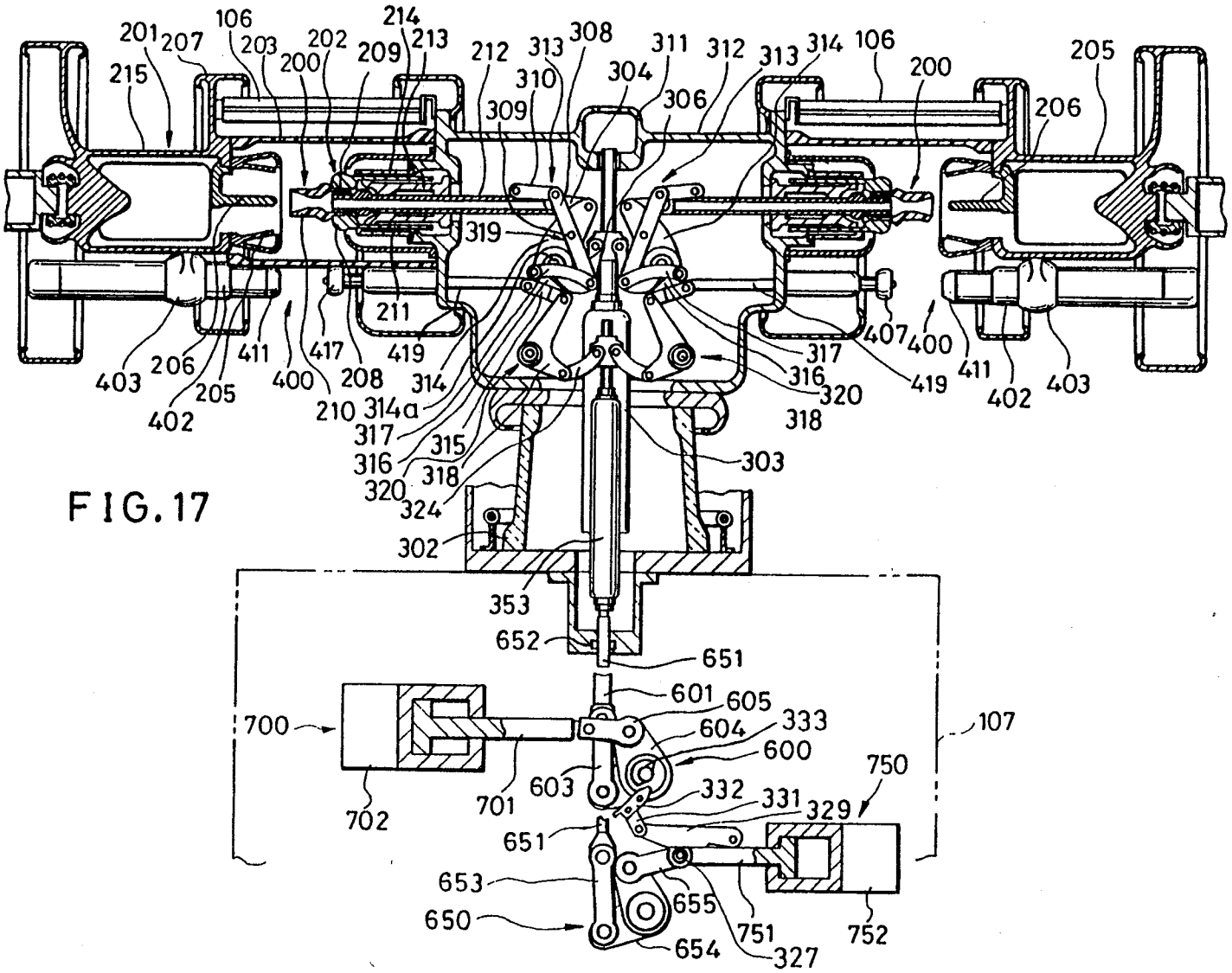
FIG. 17 is a sectional side view of a circuit breaker of the sixth embodiment in accordance with the present invention.
Figure 18:
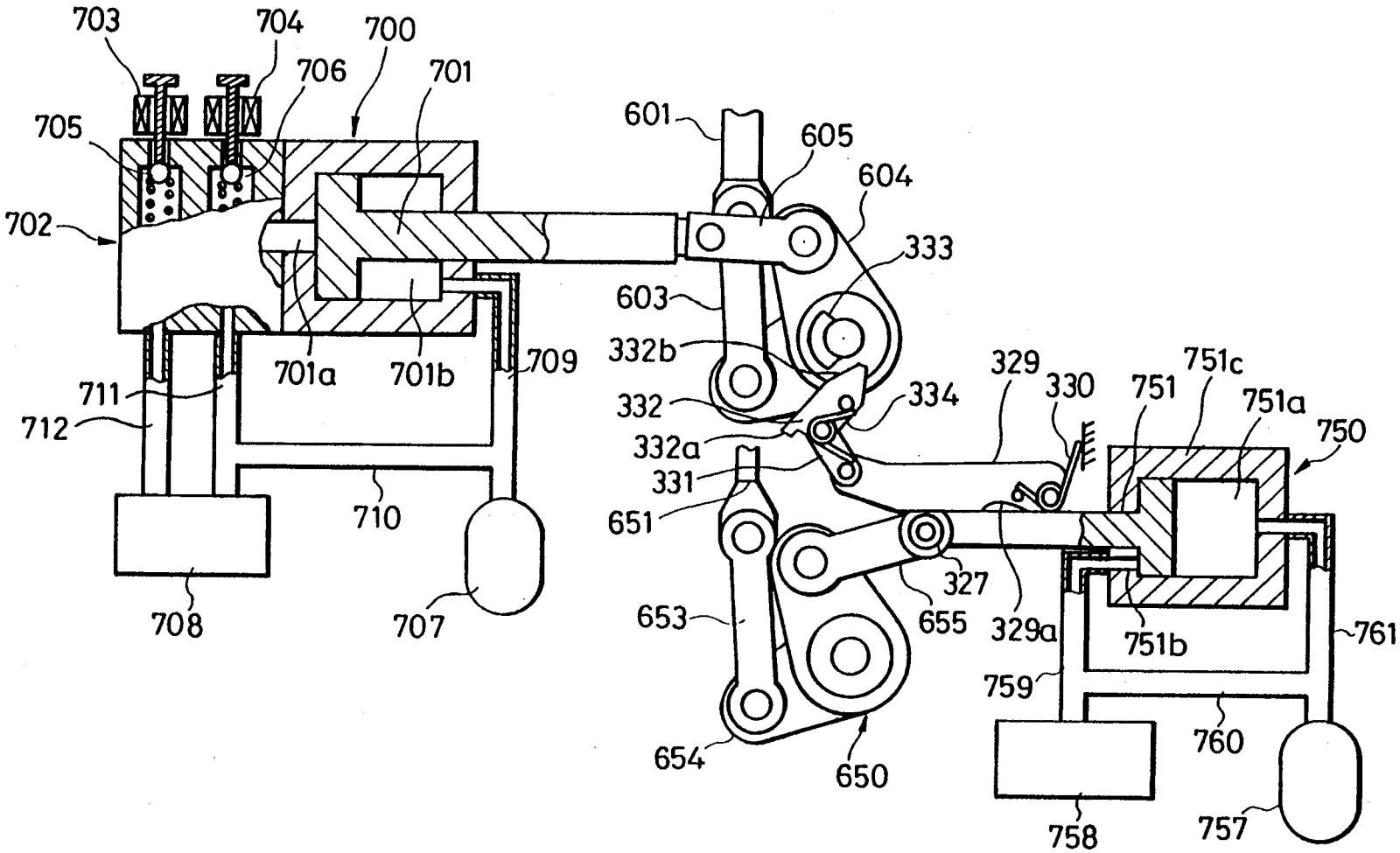
FIG. 18 is a sectional side view of a hydraulic operation system of the circuit breaker.
Figure 19:
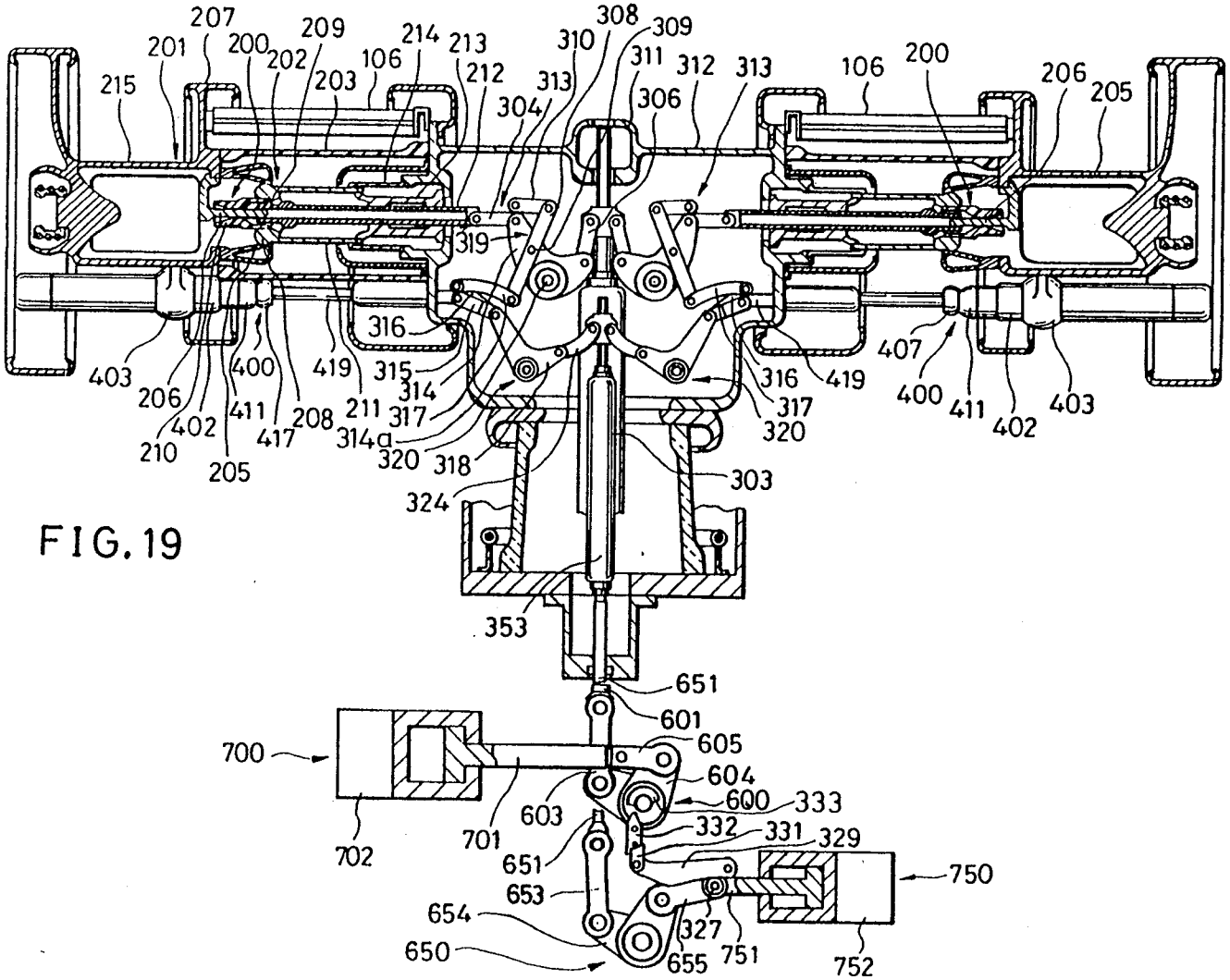
FIG. 19 is a sectional side view of the circuit breaker in FIG. 17 when the closing operation is completed.

Hereafter, a sixth embodiment of a circuit breaker in accordance with the present invention is described referring to FIGS. 17 to 19. FIG. 17 is a sectional side view of a circuit breaker of the sixth embodiment in accordance with the present invention. FIG. 18 is a sectional side view of a hydraulic operation system of the circuit breaker. FIG. 19 is a sectional side view of the circuit breaker in FIG. 17 when the closing operation is completed. In the sixth embodiment, a differential piston and an accumulator are used as an actuator of the hydraulic operation apparatus. Elements designated by the same numerals in the sixth embodiment as those of the first embodiment are substantially the same. Thereby, the explanation of the elements and motions of them are omitted.

As shown in FIG. 17, a latch 329 is rotatably pivoted on the housing 107 above the link 655 in a space between the first and second hydraulic operation apparatuses 700 and 750. In case that the circuit breaker is opened, as shown in FIG. 18, a rotation force in counterclockwise direction is applied to the latch 329 by a spring 330, and the latch 329 contacts the rod end 655. A coupling part **329*a* is formed on the latch 329. When the resister contact 400 is closed and the hydraulic piston 751 moves rightward in FIG. 18, the coupling part 329*a* couples with the roller 327. Configuration and operation of the link 331, the trigger 332, the cam 333, the spring 334** and so on are the same as those in the afore-mentioned first embodiment.

The hydraulic controller 702 is provided on the hydraulic piston 701 in the first hydraulic operation apparatus 700. The hydraulic controller 702 comprises the closing and opening electro-magnets 703 and 704 which are driven by electric closing and opening command signals, respectively. Furthermore, the hydraulic controller 702 comprises the closing and opening valves 705 and 706 which convert the operation of the electromagnets 703 and 704 to hydraulic signals, respectively. The hydraulic signals from the closing and opening valves are amplified by amplifier valves which are not shown in the figure. The amplified hydraulic signals are supplied to a head part (larger piston area side) **701*a* of a differential piston 701 for driving the differential piston 701. A pump unit 708 is connected to the hydraulic controller 702 via the pipe lines 711 and 712. A high pressure oil is supplied to the hydraulic controller 702 through the pipe line 711 from the pump unit 708. When the high pressure of the head part 701*a* of the differential piston 701 is discharged, the low pressure oil is circulated to the pump unit 708 through the pipe line 712. The high pressure oil is supplied to a rod part (smaller piston area side) 701*b* of the differential piston 701 from the pump unit 708 through pipe lines 709 and 710. An accumulator 709 is connected to the pipe lines 709 and 710. The accumulator 709 stores the high pressure oil which is charged by the pump unit 708**.

On the other hand, in the second hydraulic operation apparatus 750, a pump unit 758 is connected to a head part (larger piston area side) **751*a* of a differential piston 751 through pipe lines 760 and 761. Thereby, a high pressure oil is supplied to the head part 751*a* of the differential piston 751 from the pump unit 758. Furthermore, the pump unit 758 is connected to a rod part (smaller piston area side) 751*b* of the differential piston 751. And thereby, the high pressure oil is supplied to the rod part 751b of the differential piston 751. An accumulator 757 is connected to the pipe lines 760 and 761 for storing the high pressure oil from the pump unit 758. At this time, a thrust is generated by the difference between the pressure receiving areas of the larger piston area side 751*a* and the smaller piston area side 751*b*. Thereby, the differential piston 751 has moved leftward in FIG. 18 which is a direction to push out the rod of the piston 751** from the cylinder.

The motion of the circuit breaker in the sixth embodiment shown in FIGS. 17 to 19 is described. The operations of the switching parts provided in left-hand half part and right-hand half part are substantially the same. Thereby, the operation of the switching part in left-hand half part only is described as representive, and that in right-hand half part is omitted.

In FIG. 17 which shows that the circuit breaker is opened, the differential piston 701 in the first hydraulic operation apparatus 700 has moved leftward, and the first insulated operation rod 303 has moved downward. The differential piston 751 in the second hydraulic operation apparatus 750 has also moved leftward and the insulation rod 353 has moved downward.

In FIG. 18, when a closing command is issued, the closing electro-magnet 703 of the hydraulic controller 702 in the first hydraulic operation apparatus 700 is driven, and thereby, the closing valve 705 is opened. When the closing valve 705 is opened, the high pressure oil Is supplied to the head part (larger piston area side) **701*a* of the differential piston 701. A thrust is generated by the difference between the pressure receiving areas of the larger and smaller piston area side of the differential piston 701. Thereby, the differential piston 701 and the rod end 605 start to move rightward in FIG. 18. Following to this motion, the fourth lever 604 rotates in clockwise direction, and the shaft 601 moves upward via the eighth link 603, in FIG. 18. When the shaft 601 moves upward in FIGS. 17 and 18, the first insulated operation rod 303 also moves upward in FIG. 17. Following to the motion of the first insulated operation rod 303, the first lever 314 rotates in counterclockwise direction via the first link 306 which is coupled to the first insulated operation rod 303. By the rotation of the first lever 314, the puffer piston 211 of the main contact 200 is moved leftward in FIG. 17 via the piston rod 212 and the second link 304 which is coupled to the first lever 314**.

On the other hand, following to the rotation of the first lever 314 in counterclockwise direction, the third lever 308 which is pivoted on the first lever 314 by the pin 309 is rotated in clockwise direction around the coupling point to the seventh link 310, in FIG. 17. The sixth link 316 and fifth link 317 are moved leftward in FIG. 17 with keeping the conditions that the sixth link 316 and fifth link 317 are folded and the coupling point of the sixth link 316 and fifth link 317 contacts the fourth link 315. By the motion of the sixth link 316 and fifth link 317, the moving resister contact 417 of the resister contact 400 is moved to contact the fixed resister contact 411 via the rod 419. Since the second lever 318 is coupled to the fourth link 315 and sixth link 316, the second lever 318 is rotated in counterclockwise direction in FIG. 17. Following to the rotation of the second lever 318, the second insulated operation rod 353 is moved upward. When the second insulated operation rod 353 is moved upward, the fifth lever 654 which is coupled to the second insulated operation rod 353 via the shaft 651 and the ninth link 653 is rotated in clockwise direction in FIGS. 17 and 18. Thereby, the differential piston 751 in the second hydraulic operation apparatus 750 is moved rightward in FIGS. 17 and 18 against the leftward thrust. As a result, a hydraulic force is charged in the second hydraulic operation apparatus 750.

In FIG. 18, when the differential piston 751 moves rightward, the roller 327 moves rightward. At the final stage of the closing operation, the latch 329 which is slidably guided by the rod end 655 is rotated in counterclockwise direction by the spring 330 and stopped at a position where the coupling part 329*a* of the latch 329 is able to couple with the roller 327. Following to the rotation of the fourth lever 604 in clockwise direction, the contact part 332*b* of the trigger 332 becomes free from the restriction of the cam 333. Following to this motion, the trigger 332 and the link 331 which is coupled to the latch 329 are expanded by the spring 334, and the expansion is stopped when the stopper 332*a* touches the link 331.

When the differential piston 701 in the first hydraulic operation apparatus 700 reaches to the final position, the closing operation of the circuit breaker is completed. The state of the circuit breaker when the closing operation is completed is shown in FIG. 19. Hereupon, a predetermined tolerance is provided between the coupling part 329*a* and the roller 327.

Next, the opening operation of the circuit breaker is described referring to FIG. 19. In FIG. 19 which shows the closed state of the circuit breaker, when an opening command is issued, the opening electro-magnet 704 of the hydraulic controller 702 in the first hydraulic operation apparatus 700 is driven, and thereby the opening valve 706 is opened. When the opening valve 706 is opened, the high pressure oil in the head part (larger piston area side) 701*a* of the differential piston 701 is discharged. A thrust is generated by the pressure in the smaller piston area side of the differential piston 701. Thereby, the differential piston 701 and the rod end 605 start to move leftward in FIG. 19. Following to this motion, the fourth lever 604 rotates in counterclockwise direction, and the shaft 601 moves downward via the eighth link 603, in FIG. 19. When the shaft 601 moves downward, the first insulated operation rod 303 also moves downward in FIG. 19. Following to the motion of the first insulated operation rod 303, the first lever 314 rotates in clockwise direction via the first link 306 which is coupled to the first insulated operation rod 303. By the rotation of the first lever 314, the puffer piston 211 of the main contact 200 is moved rightward in FIG. 19 via the piston rod 212 and the second link 304 which is coupled to the first lever 314.

On the other hand, following to the rotation of the first lever 314 in clockwise direction, the third lever 308 which is pivoted on the first lever 314 by the pin 309 is rotated in counterclockwise direction around the coupling point to the seventh link 310, in FIG. 19. The sixth link 316 and fifth link 317 are moved rightward in FIG. 19. When the sixth link 316 and fifth link 317 move, the restriction of the rotation of the second lever 318 by the fourth link 315 and sixth link 316 is released. Thereby, the differential piston 751 in the second hydraulic operation apparatus 750 is able to move by the stored thrust in the second hydraulic operation apparatus 750. However, when the differential piston 751 moves a little, the roller 327 couples with the coupling part 329*a* of the latch 329. At this time, the latch 329 receives a clockwise rotation force from the roller 327 against the counterclockwise rotation force of the spring 330. By such clockwise rotation force, an upward force is applied to the link 331. Since the rotation force in counterclockwise direction is applied to the trigger 332 and the link 331 by the spring 334 shown in FIG. 18, the stopper 332*a* touches the link 331 as shown in FIG. 19. At this time, the contact part 332*b* of the trigger 332 is engaged with the cam 333, thereby the latch 329 can not rotate.

In the sixth embodiment configured above, the latch 329 couples with the roller 327 in the initial stage of the opening operation of the circuit breaker. Therefore, the mechanical reliability of the hydraulic operation system becomes higher.

By the engagement of the latch 329 and the roller 327, the differential piston 751 is kept in the charged position. Thereby, the motion of the second lever 318, the fourth link 315 the rod 419 and the moving resister contact 417 are restrained. As a result, the resister contact 400 is kept in the closed state.

When the fourth lever 604 further rotates in counterclockwise direction, and reaches the final stage of the opening operation, the cam 333 which is provided on the fourth lever 604 pushes the contact part 332*b* of the trigger 332. Thereby, the trigger 332 is rotated in clockwise direction, the stopper 332*a* departs from the link 331, and the trigger 332 and the link 331 are folded against the rotation force of the spring 334. As a result, the restriction of the latch 329 is released, and the latch 329 is rotated in clockwise direction by the rotation force from the roller 327. Finally, the latch 329 moves to a position where the latch 329 can not couple with the roller 327.

When the restriction of the latch 329 is released, the differential piston 751 in the second hydraulic operation apparatus 750 and the second rod end 655 starts to move leftward in FIG. 19 by the stored thrust in the second hydraulic operation apparatus 750. Following to these motions, the fifth lever 654 is rotated in counterclockwise direction, and the shaft 651 is moved downward in FIG. 19. By the above-mentioned operations, the circuit breaker returns to the initial state as shown in FIGS. 17 and 18.

In the sixth embodiment configured above, the second hydraulic operation apparatus 750 is charged during the closing operation wherein the driving force for moving the main contact 200 and the resister contact 400 is relatively smaller. And the stored thrust in the second hydraulic operation apparatus 750 is released in the opening operation. Thereby, the driving force of the first hydraulic operation apparatus 700 is effectively used.

Furthermore, the second hydraulic operation apparatus 750 for opening the resister contact 400 is constituted by the cylinder 751*c*, the differential piston 751, the accumulator 757 and the pump unit 758. As a result, a means for controlling the motion of the differential piston 751 is not necessary, and the total size of the second hydraulic operation apparatus 750 can be downsized.

Seventh Embodiment

Figure 20:
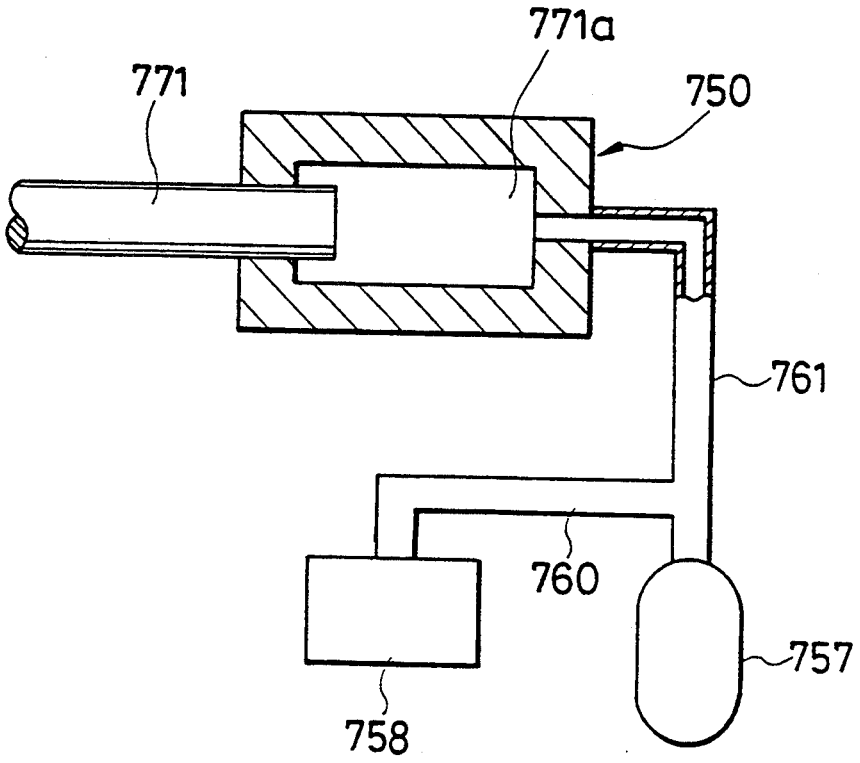
FIG. 20 is a sectional side view of a second hydraulic operation apparatus of the circuit breaker of the seventh embodiment.

Hereafter, a seventh embodiment of a circuit breaker in accordance with the present invention is described referring to FIG. 20. FIG. 20 is a sectional side view of a second hydraulic operation apparatus of the circuit breaker of the seventh embodiment. Elements designated by the same numerals in the seventh embodiment as those of the sixth embodiment are substantially the same. Thereby, the explanation of them are omitted.

In the afore-mentioned sixth embodiment, the high pressure oil is supplied to the head part (larger piston area side) 751*a* of the differential piston 751 through the pipe lines 760 and 761 from the pump unit 758. Furthermore, the high pressure oil is supplied to the rod part (smaller piston area side) 751*b* of the differential piston 751 through the pipe line 759 from the pump unit 758.

On the other hand, in the seventh embodiment shown in FIG. 20, a piston 771 has an uniform diameter, the high pressure oil is supplied into a cylinder 771*a* through the pipe lines 760 and 761 from the pump unit 758.

In the seventh embodiment configured above, a thrust is applied to the piston 771 leftward in FIG. 20 for pushing out the piston 771 from the cylinder 771*a*. Thereby, the arrangement of the pipe lines in the second hydraulic operation apparatus 750 becomes simple.

Eighth Embodiment

Figure 21:
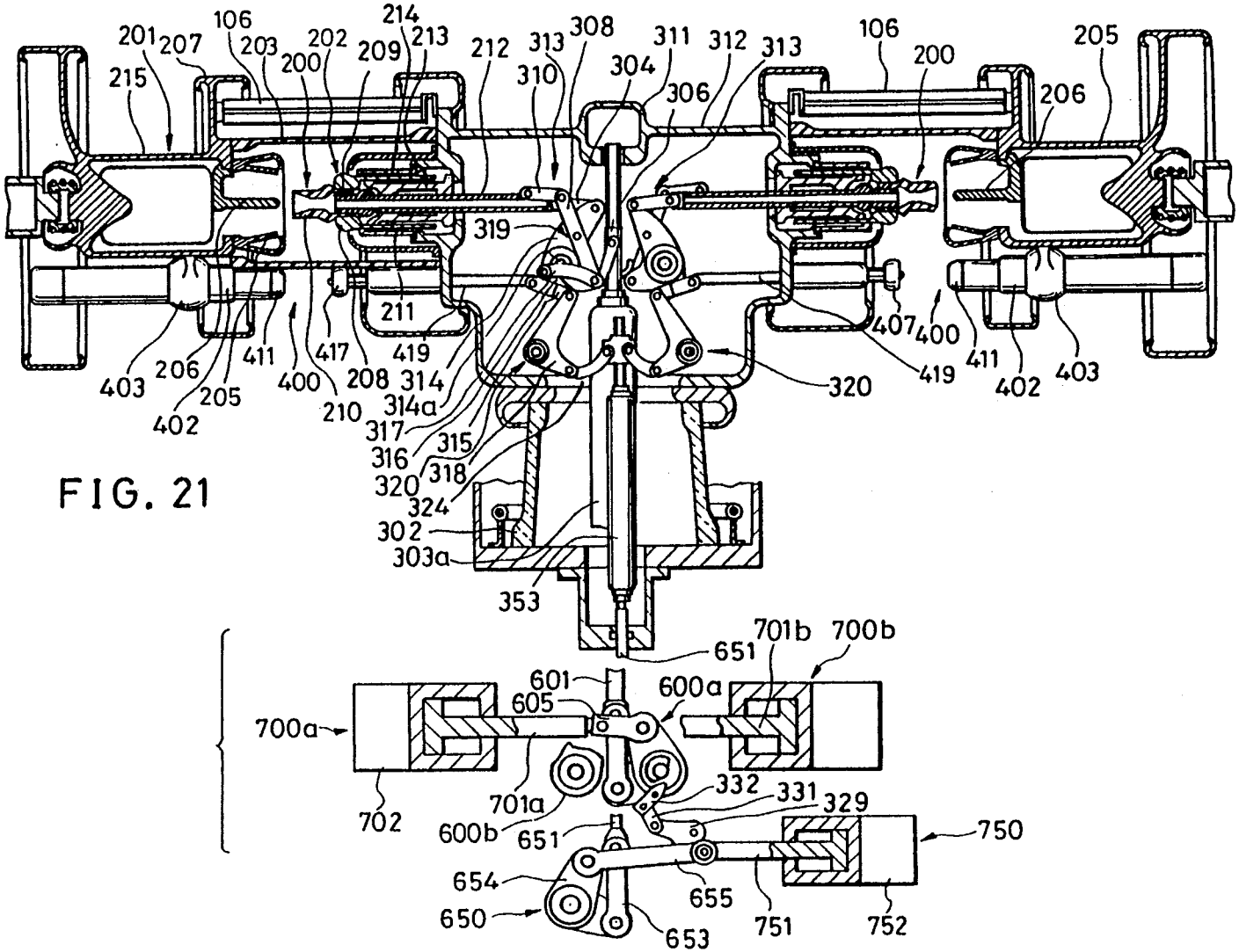
FIG. 21 is a sectional side view of a circuit breaker of the eighth embodiment in accordance with tile present invention.
Figure 23:
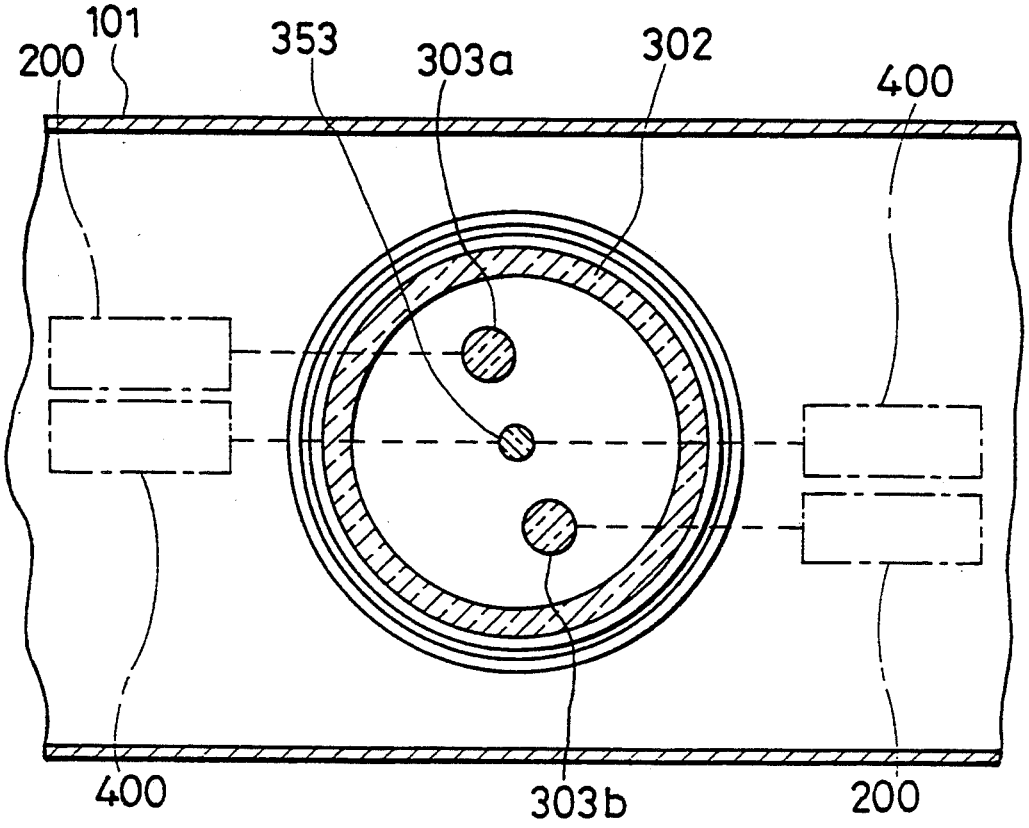
FIG. 23 is a sectional plane view showing the arrangement of insulated operation rods of the circuit breaker shown in FIG. 21.
Figure 24:
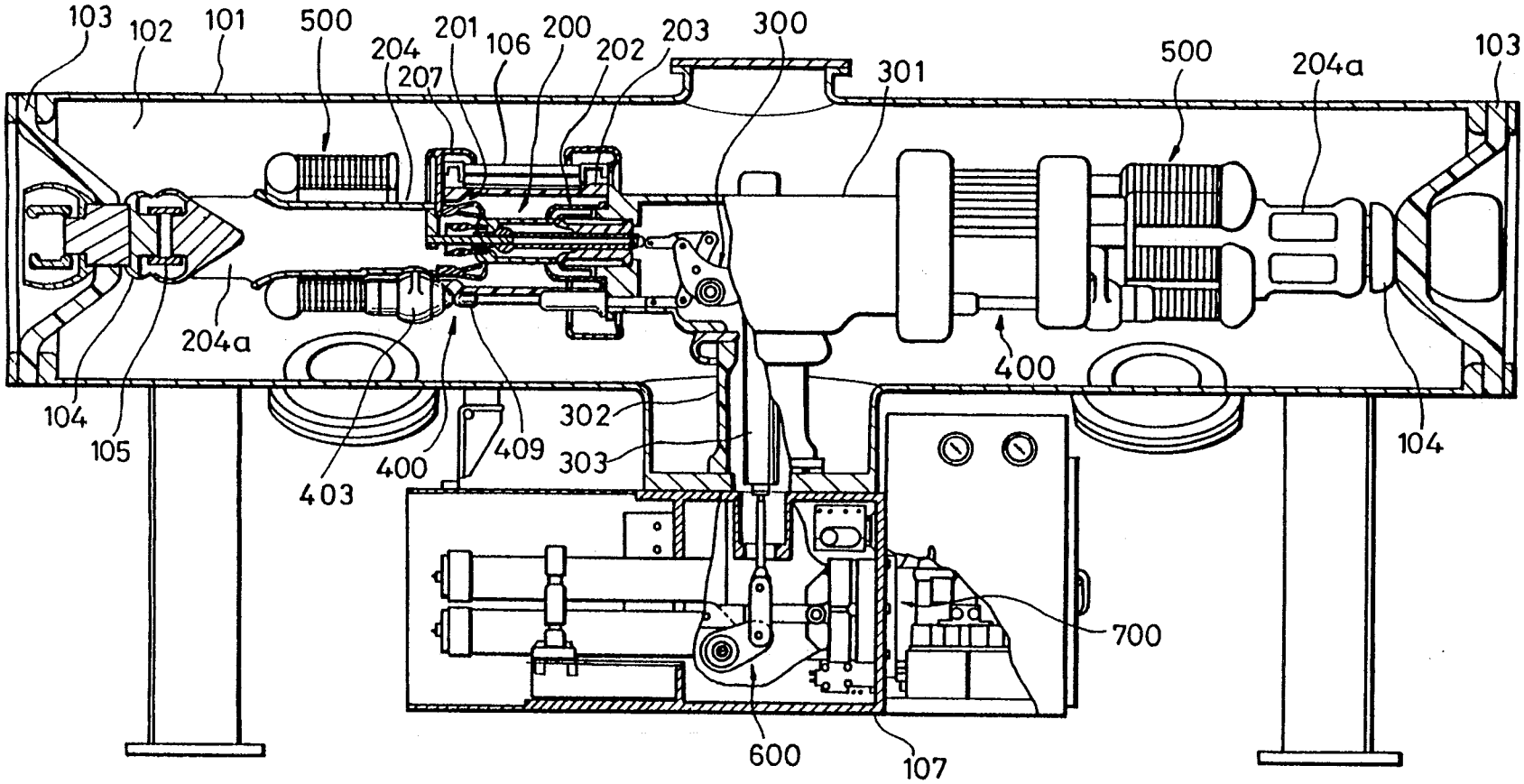
FIG. 24 (Prior Art)
FIG. 24 is the sectional side view showing the constitution of the conventional circuit breaker.
Figure 25:
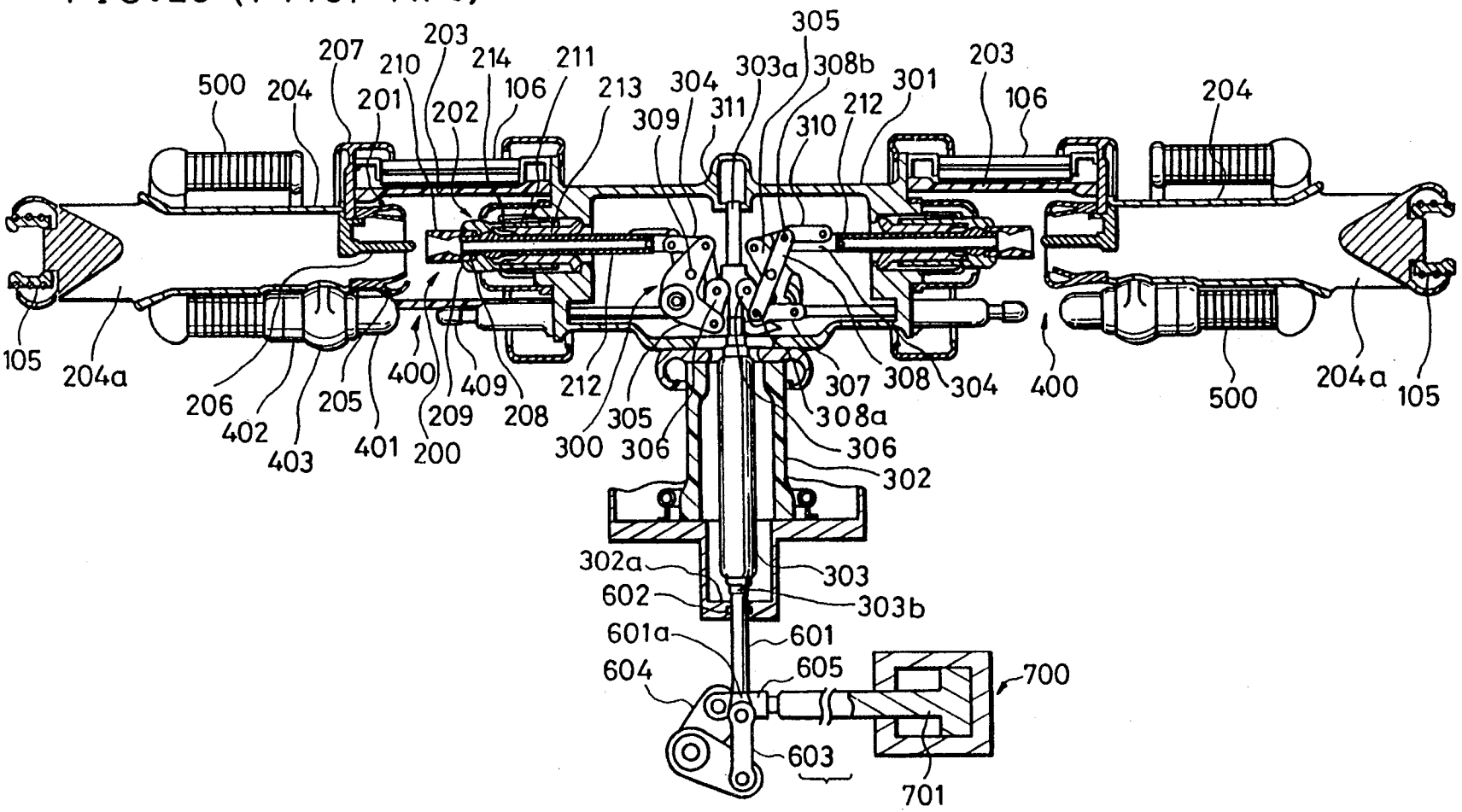
FIG. 25 (Prior Art)
FIG. 25 is the sectional side view showing the detailed constitution of the switching part of the conventional circuit breaker.
Figure 26:
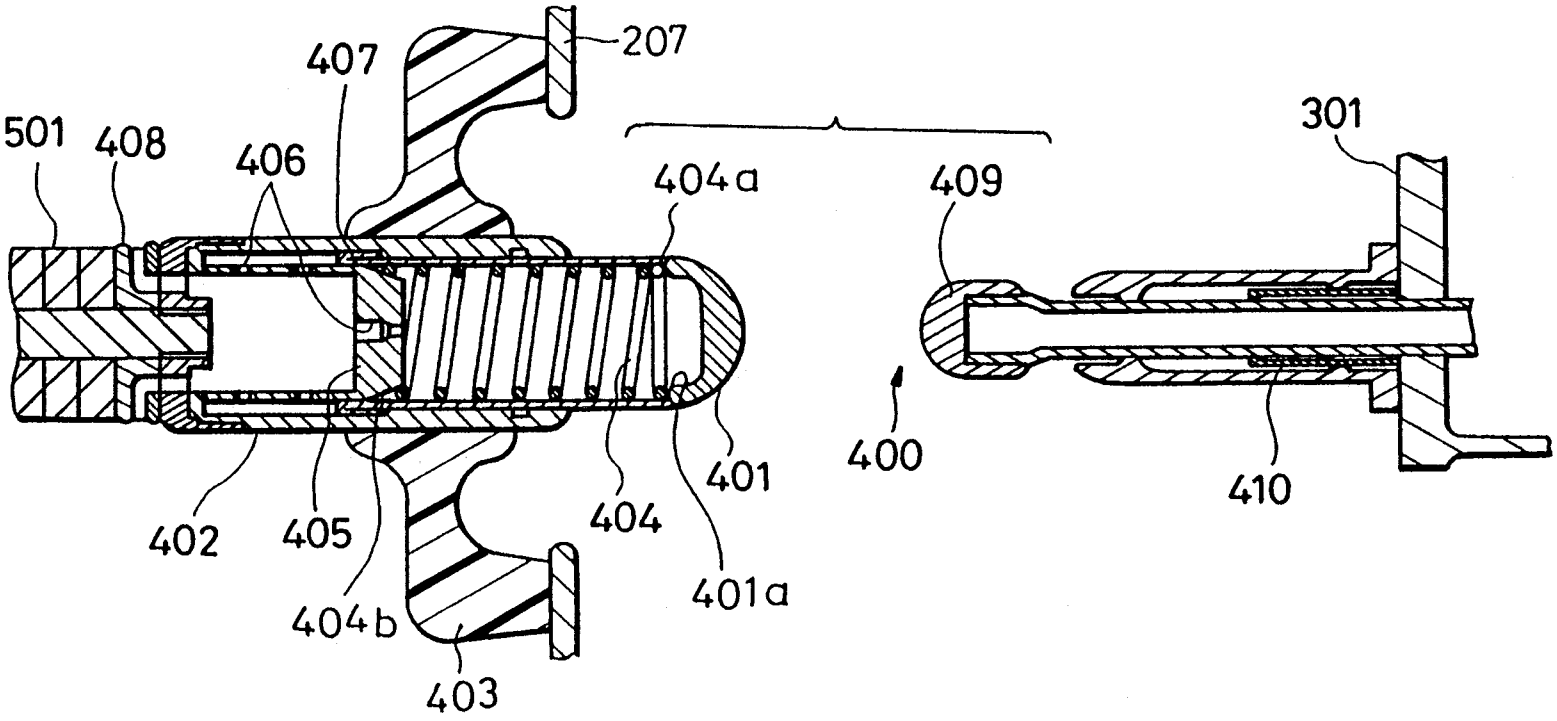
FIG.26 (Prior Art)
FIG. 26 is the sectional side view showing the detailed constitution of the resistor contact of the conventional circuit breaker.
Figure 27:
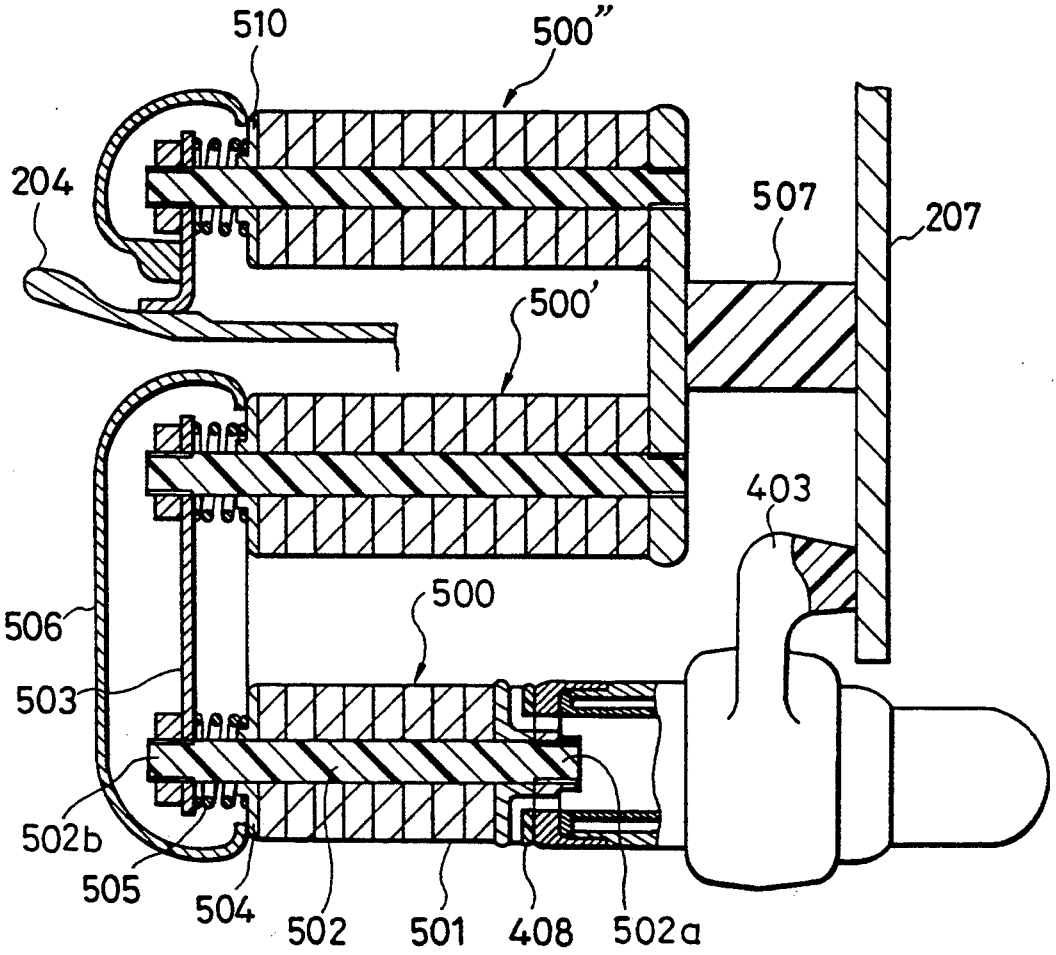
FIG. 27 (Prior Art)
FIG. 27 is the sectional side view showing the detailed constitution of the resistor of the conventional circuit breaker.
Figure 28:
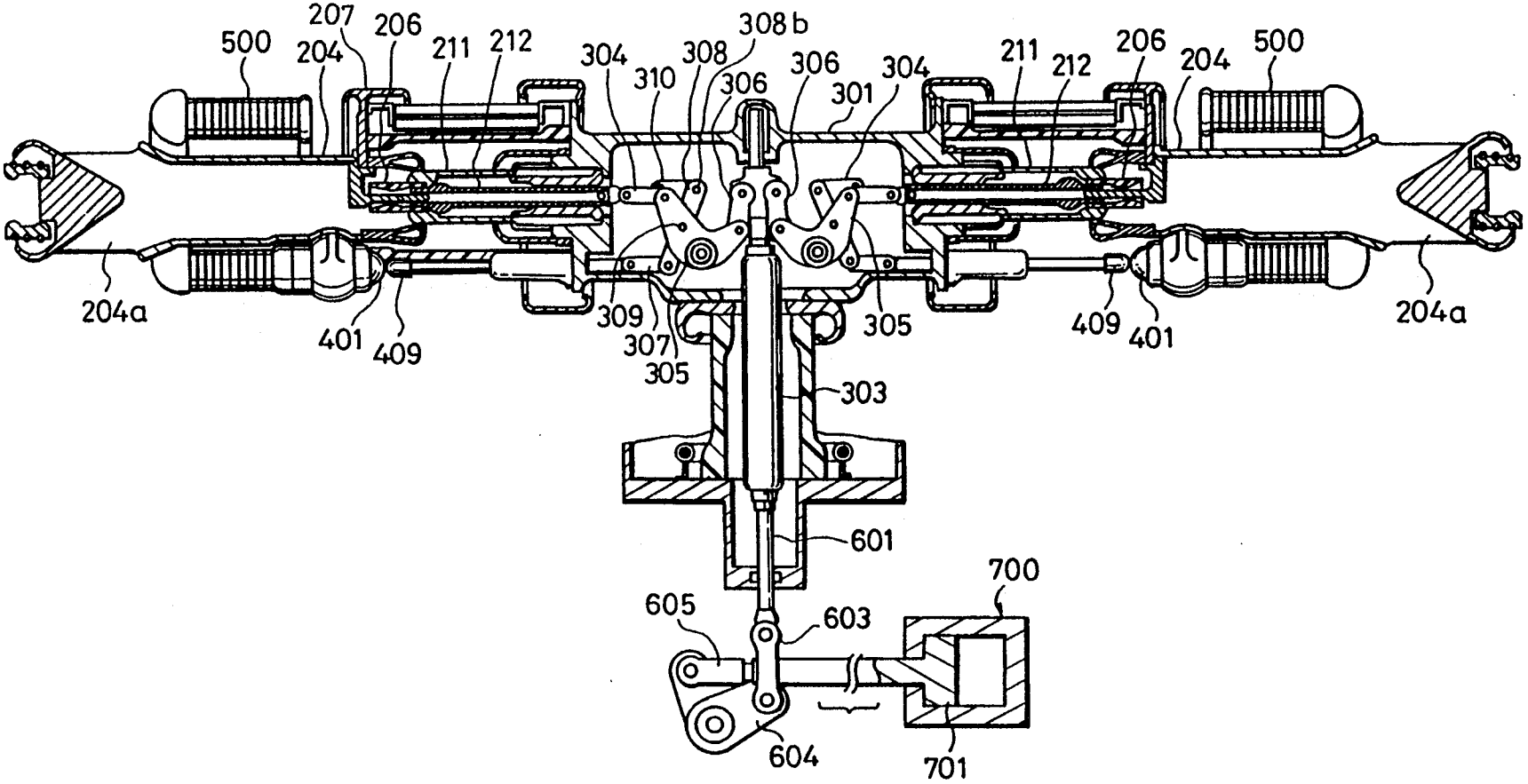
FIG. 28 (Prior Art)
FIG. 28 is the sectional side view showing the switching part of the conventional circuit breaker in the closed state.
Figure 29:
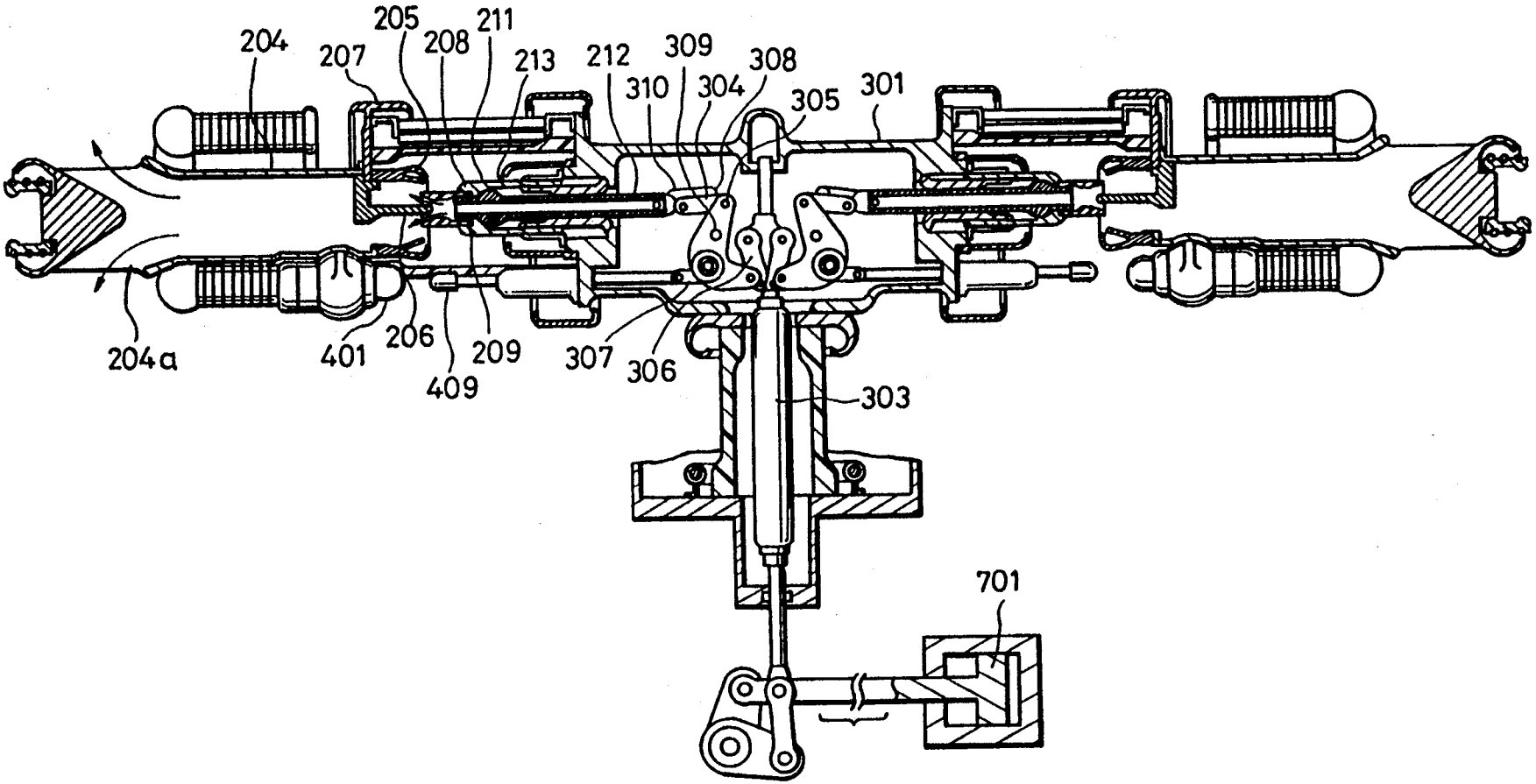
FIG. 29 (Prior Art)
FIG. 29 is the sectional side view showing the switching part of the conventional circuit breaker in the way of the opening operation.

Hereafter, an eighth embodiment of a circuit breaker in accordance with the present invention is described referring to FIGS. 21 and 23. FIG. 21 is a sectional side view of a circuit breaker of the eighth embodiment in accordance with the present invention. FIG. 23 is a sectional plane view showing the arrangement of insulated operation rods of the circuit breaker shown in FIG. 21.

In the afore-mentioned first to seventh embodiments, both of the main contacts 200 which are positioned rightward and leftward are commonly driven by one first hydraulic operation apparatus 700 via one first insulated operation rod 303.

On the other hand, in the eighth embodiment, both of the main contacts 200 which are positioned rightward and leftward In FIG. 21 are respectively coupled to independent two first insulated operation rods 303*a* and 303*b* and driven by independent two first hydraulic operation apparatuses 700*a* and 700*b*.

Elements designated by the same numerals in the eighth embodiment as those of the first embodiment are substantially the same. Thereby, the explanation of the elements and motions of them are omitted.

As shown in FIG. 23, the second insulated operation rod 353 which is connected to the resister contacts 400 is positioned the center of the insulation holder 302. The first insulated operation rods 303*a* and 303*b* are positioned symmetrical to the center of the insulation holder 302. The first insulated operation rods 303*a* and 303*b* are respectively coupled to the first hydraulic operation apparatuses 700*a* and 700*b* which are provided in the operation housing via the link mechanisms 600*a* and 600*b* in the atmosphere.

In the eighth embodiment configured above, the same insulation holder 302 is usable as that in the first to seventh embodiment wherein the first insulated operation rod 303 is only one.

As shown In FIG. 21, the first hydraulic operation apparatuses 700*a* and 700*b* are positioned symmetrical in a manner that the directions of the driving forces of them are opposing to each other. The second hydraulic operation apparatus 750 is provided in a manner that the direction of the driving force thereof is the same as that of the first hydraulic operation apparatus 700*a* or 700*b*, but the elevation of the second hydraulic operation apparatus 750 is different from those of the first hydraulic operation apparatuses 700*a* and 700*b*. The interlock mechanism (329, 331 and 332) which restrict the motion of the fourth link mechanism 650 is provided in a manner to be coupled with the cam 333 which is provided on the link mechanism 600*a* or 600*b*.

In the eighth embodiment shown in FIG. 21, the hydraulic operation system, especially the second hydraulic operation apparatus 750 and the fourth link mechanism 650 are substantially the same as those in the first to fifth embodiments.

Ninth Embodiment

Figure 22:
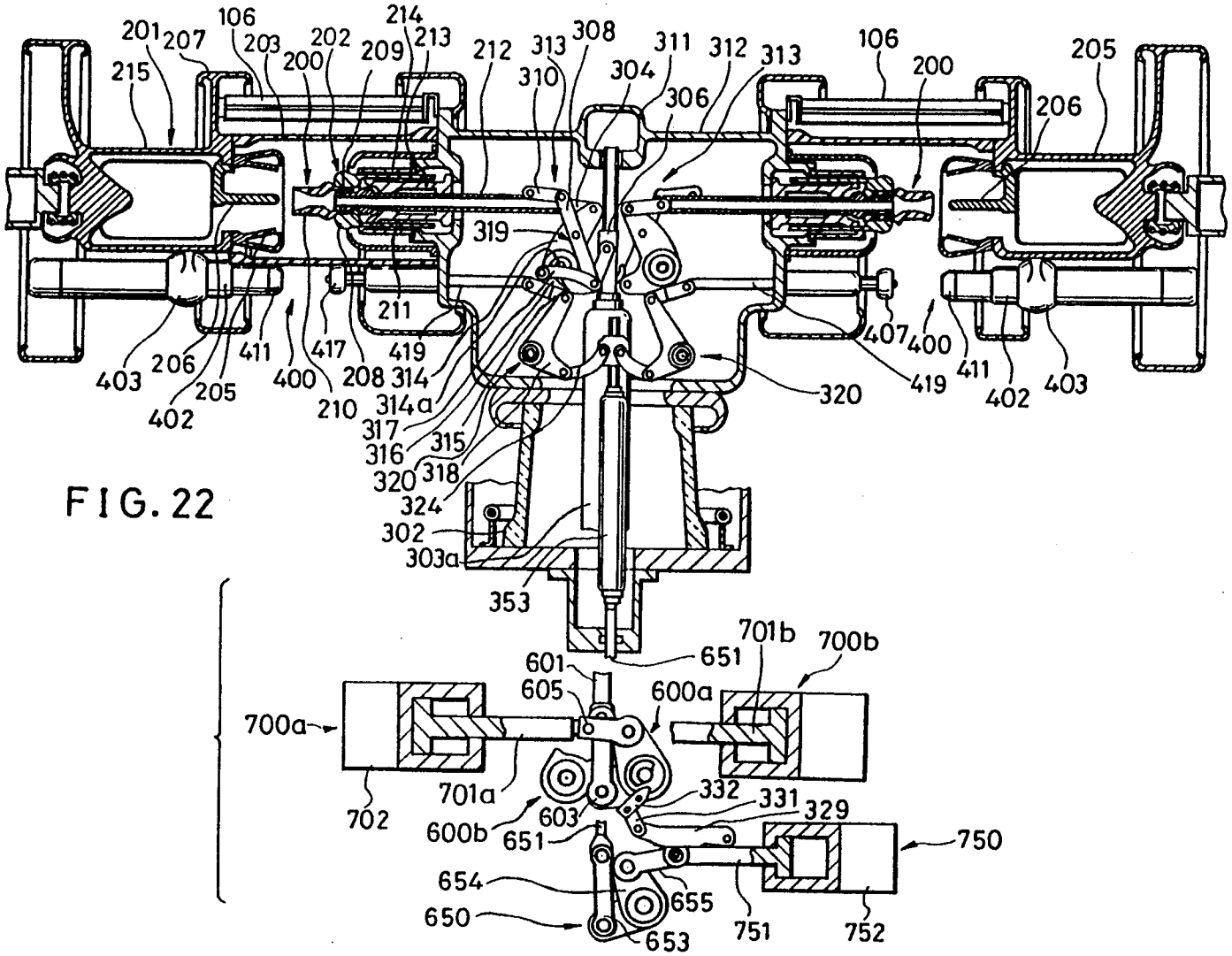
FIG. 22 is a sectional side view of a circuit breaker of the ninth embodiment in accordance with the present invention.

A ninth embodiment of the circuit breaker in accordance with the present invention is shown in FIG. 22. The constitution of the circuit breaker shown in FIG. 22 is substantially the same as that in the eighth embodiment shown in FIG. 21. However, the hydraulic operation system is different from that in the eighth embodiment shown in FIG. 21. Namely, the hydraulic operation system shown in FIG. 22 is substantially tile same as those in the sixth and seventh embodiments.

In the above-mentioned eighth and ninth embodiments, two first hydraulic operation apparatuses 700*a* and 700*b* are used for driving the main contacts 200. Thereby, the power of one first hydraulic operation apparatus 700*a* or 700*b* can be reduced. And the total size of the hydraulic operation system can be downsized.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A circuit breaker, comprising:

a tank filled with an insulation gas and having an axial direction along a horizontal axis;

two main contacts which are electrically connected in series in said tank in a manner such that main moving contacts of said main contacts are driven in the axial direction of said tank for contacting and departing from stationary main contacts of said main contacts;

series connections of resistors and a resistor contact which are respectively provided in said tank in such a manner that they are electrically connected in parallel with said main contacts when they and the main contacts are closed;

a first insulation operation rod and a second insulation operation rod which are driven in a direction that is perpendicular to the horizontal axis of said tank and provided between said main contacts;

a first link mechanism for coupling between a top end of said first insulation operation rod and one main contact of the two main contacts;

a second link mechanism for coupling between a top end of said second insulation operation rod and said resistor contact;

a first hydraulic operation apparatus and a second hydraulic operation apparatus which are provided below said tank;

a third link mechanism for coupling between a bottom end of said first insulation operation rod and said first hydraulic operation apparatus; and a fourth link mechanism for coupling between a bottom end of said second insulation operation rod and said second hydraulic operation apparatus.

2. A circuit breaker in accordance with claim 1, wherein:

said first hydraulic operation apparatus has closing operation control means for converting an electric closing signal to a hydraulic closing signal, thereby said first hydraulic operation apparatus starts to close said main contacts;

said hydraulic closing signal is applied to the first and second hydraulic operation apparatus at the same time, thereby said second hydraulic operation apparatus starts to close said resistor contacts; and wherein a driving speed of said second hydraulic operation apparatus is faster than that of said first hydraulic operation apparatus.

3. A circuit breaker in accordance with claim 1, further comprising:

a trigger means for detecting a predetermined motion of said third link mechanism and converting a mechanical motion of said third link mechanism to a hydraulic opening signal;

wherein said first hydraulic operation apparatus has an opening operation control means for converting an electric opening signal to a hydraulic opening signal whereby said first hydraulic operation apparatus starts to open said main contacts;

an interlock means for restricting motion of the fourth link mechanism, which is released by a motion of said third link mechanism when said third link mechanism moves by a predetermined stroke after opening said main contacts; and said trigger means supplies said hydraulic opening signal to said second hydraulic operation apparatus, whereby said second hydraulic operation apparatus starts to open said resistor contacts via said third link mechanism.

4. A circuit breaker in accordance with claim 1, further comprising:

means for detecting that a first hydraulic piston of said first hydraulic operation apparatus reaches a limit position in the opening operation, and means for outputting a hydraulic opening signal to said second hydraulic operation apparatus instructing said second hydraulic operation apparatus to start opening said resistor contacts.

5. A circuit breaker in accordance with claim 1, further comprising:

a pair of said first insulation operation rods which are provided symmetrically to said second insulated operation rod;

a pair of said first hydraulic operation apparatuses are provided below said tank;

a pair of said first link mechanisms are respectively provided for coupling between top ends of said first insulation operation rods and said main contacts; and a pair of third link mechanisms are respectively provided for coupling between the bottom ends of said first insulation operation rods and said first hydraulic operation apparatuses.

6. A circuit breaker in accordance with claim 5, wherein said pair of first hydraulic operation apparatuses are disposed in a manner such that the moving direction of said first hydraulic pistons oppose one another;

said second hydraulic operation apparatus is disposed in a manner such that the moving direction of said second hydraulic piston is substantially the same as one of moving directions of said first hydraulic pistons, but the elevation of said second hydraulic operation apparatus is different from those of said first hydraulic operation apparatuses; and interlock means, for restricting the motion of said fourth link mechanism, which is disposed between a pair of said third link mechanisms and said fourth link mechanism.

7. A circuit breaker according to claim 1, comprising:

closing operation control means for converting an electrical closing signal to a hydraulic closing signal provided on said first hydraulic operation apparatus or said second hydraulic operation apparatus in closing operation of said main contacts and said resistor contacts;

a pipe line for transmitting said hydraulic closing signal from said closing operation control means to the other one of said hydraulic operation apparatus, thereby making said main contacts and said resistor contacts start to close at the same time, when said electric closing signal is input to said closing operation control means;

opening operation control means for converting an electric opening signal to a hydraulic opening signal;

means for transmitting said hydraulic opening signal to said first hydraulic operation apparatus for initiating opening operation of said main contacts and said resistor contacts, thereby making said main contacts start to open in response to movement of said first hydraulic operation apparatus via said third link mechanism, when said electric opening signal is inputted to said opening operation control means;

trigger means for triggering motion of a mechanical link, driven by a fourth lever of said third link mechanism, that is rotatably borne on an operation housing enclosing the hydraulic operation apparatuses when said fourth lever rotates a predetermined angle after opening of said main contacts;

mechanical link means, comprising the mechanical link, for transmitting motion of said trigger means to said second hydraulic operation apparatus; and converting means for converting said motion of said trigger means to a hydraulic opening signal, thereby initiating movement of said second hydraulic operation apparatus to initiate opening of said resistor contacts.

8. A circuit breaker according to claim 1, comprising:

closing operation control means for converting an electrical closing signal to a hydraulic closing signal provided on said first hydraulic operation apparatus or said second hydraulic operation apparatus, for initiating a closing operation of said main contacts and said resistor contacts;

a pipe line for transmitting said hydraulic closing signal from said closing operation control means to the other one of said hydraulic operation apparatus, thereby initiating closing of said main contacts and said resistor contacts at the same time, which is when said electric closing signal is input to said closing operation control means;

opening operation control means for converting an electric opening signal to a hydraulic opening signal provided on said first hydraulic operation apparatus for initiating an opening operation of said main contacts and said resistor contacts, thereby initiating opening of said main contacts in response to movement of said first hydraulic operation apparatus via said third link mechanism when said electric opening signal is input to said opening operation control means; and hydraulic circuit means for detecting when a first hydraulic piston of said first hydraulic operation apparatus reaches a limit position and for outputting a predetermined hydraulic signal to said second hydraulic operation apparatus via a pipe line, thereby said second hydraulic operation apparatus initiating opening of said resistor contacts.

9. A circuit breaker, comprising:

a tank filled with an insulation gas;

a pair of main contacts disposed in said tank in a manner that moving directions of main moving contacts thereof are opposing to each other;

a first insulated operation rod driven in a direction that is perpendicular to said moving directions of said main moving contacts;

a first link mechanism comprising: a first link which is coupled to a top end of said first insulated operation rod; a second link which is coupled to one main moving contact of one of the pair of main contacts; and a first lever which is coupled between said first link and said second link and rotatably borne on said tank;

a pair of series connection of a resistor and a resistor contact disposed in said tank in a manner such that moving directions of moving resistor contacts thereof are opposing to each other;

a second insulated operation rod in said tank in a manner such that a moving direction thereof is perpendicular to said moving directions of said moving resistor contacts;

a second link mechanism comprising: a third link which is coupled to a top end of said second insulated operation rod; a fourth link which is coupled to a moving resistor contact of said moving resistor contacts; and a second lever which is coupled between said third link and said fourth link and rotatably borne on said tank;

a fifth link mechanism comprising: a seventh link having an end being rotatably borne on said tank; a third lever rotatably borne on said first lever and having an end being coupled to the other end of said seventh link; a fifth link having an end being coupled to the other end of said third lever; a sixth link coupled between the other end of said fifth link and the other end of said second lever; and said fifth and sixth links being folded when said main contacts and said resistor contacts are at opened and closed positions;

first and second hydraulic operation apparatuses below said tank;

a third link mechanism disposed below said first insulated operation rod and comprising: a first shaft which is connected to a bottom end of said first insulated operation rod and arranged to project outside the tank from said tank through a first hermetic seal; a fourth lever rotatably borne on an operation housing; an eighth link connected between an end of said fourth lever and a bottom end of said first shaft; and a first rod end coupled between the other end of said fourth lever and an end of a first hydraulic piston of said first hydraulic operation apparatus;

a fourth link mechanism disposed below said second insulated operation rod and comprising: a second shaft which is connected to a bottom end of said second insulated operation rod and arranged to project out of the tank from said tank through a second hermetic seal; a fifth lever rotatably borne on an operation housing; a ninth link connected between an end of said fifth lever and a bottom end of said second shaft; and a second rod end coupled between the other end of said fifth lever and an end of a second hydraulic piston of said second hydraulic operation apparatus; and interlock means for engaging said fourth link mechanism, provided between said third and fourth link mechanisms in a manner that, in case of opening operation of said main contacts and said resistor, said interlock means engages said fourth link mechanism for holding a driving force of said second hydraulic operation apparatus, wherein said main contacts are opened when said fourth lever of said third link mechanism rotates a first predetermined angle, engagement of said interlock means and said fourth link mechanism are released when said fourth lever rotates a second predetermined angle, and thereby said resistor contacts are opened by said driving force of said second hydraulic operation apparatus.

10. A circuit breaker in accordance with claim 9, further comprising:

closing operation control means, provided on said first hydraulic operation apparatus or said second hydraulic operation apparatus, for converting an electrical closing signal to a hydraulic closing signal in closing operation of said main contacts and said resistor contacts;

a pipe line for transmitting said hydraulic closing signal from said closing operation control means to the other one of said hydraulic operation apparatus, thereby making said main contacts and said resistor contacts start to close at the same time, when said electric closing signal is input to said closing operation control means;

opening operation control means for converting an electric opening signal to a hydraulic opening signal;

means for transmitting said hydraulic opening signal to said first hydraulic operation apparatus for initiating opening operation of said main contacts and said resistor contacts, thereby making said main contacts start to open in response to movement of said first hydraulic operation apparatus via said third link mechanism, when said electric opening signal is inputted to said opening operation control means;

trigger means for triggering motion of a mechanical link, driven by a fourth lever of said third link mechanism that is rotatably borne on an operation housing enclosing the hydraulic operation apparatuses, when said fourth lever rotates a predetermined angle after opening of said main contacts;

mechanical link means, comprising the mechanical link, for transmitting motion of said trigger means to said second hydraulic operation apparatus; and converting means for converting said motion of said trigger means to a hydraulic opening signal, thereby initiating movement of said second hydraulic operation apparatus to initiate opening of said resistor contacts.

11. A circuit breaker in accordance with claim 9, further comprising:

closing operation control means for converting an electrical closing signal to a hydraulic closing signal provided on said first hydraulic operation apparatus or said second hydraulic operation apparatus, for initiating a closing operation of said main contacts and said resistor contacts;

a pipe line for transmitting said hydraulic closing signal from said closing operation control means to the other one of said hydraulic operation apparatus, thereby initiating closing of said main contacts and said resistor contacts at the same time, when said electric closing signal is input to said closing operation control means;

opening operation control means for converting an electric opening signal to a hydraulic opening signal provided on said first hydraulic operation apparatus for initiating an opening operation of said main contacts and said resistor contacts, thereby initiating opening of said main contacts in response to movement of said first hydraulic operation apparatus, via said third link mechanism when said electric opening signal is input to said opening operation control means; and hydraulic circuit means for detecting when said first hydraulic piston of said first hydraulic operation apparatus reaches a limit position and for outputting a predetermined hydraulic signal to said second hydraulic operation apparatus via a pipe line, thereby said second hydraulic operation apparatus initiating opening of said resistor contacts.

12. A circuit breaker, comprising:

a tank filled with an insulation gas and having an axial direction along a horizontal axis;

two main contacts which are electrically connected in series in said tank in a manner such that main moving contacts of said main contacts are driven in the axial direction of said tank for contacting and departing from stationary main contacts of said main contacts;

series connections of resistors and a resistor contact which are respectively provided in said tank in such a manner that they are electrically connected in parallel with said main contacts when they and the main contacts are closed;

a first insulation operation rod and a second insulation operation rod which are driven in a direction that is perpendicular to the horizontal axis of said tank and provided between said main contacts;

a first link mechanism for coupling between a top end of said first insulation operation rod and one main contact of the two main contacts;

a second link mechanism for coupling between a top end of said second insulation operation rod and said resistor contact;

a first hydraulic operation mechanism and a second hydraulic apparatus which are provided below said tank;

a third link mechanism for coupling between a bottom end of said first insulation operation rod and said first hydraulic operation apparatus;

a fourth link mechanism for coupling between a bottom end of said second insulation operation rod and said second hydraulic operation apparatus; and interlink means provided between the third link mechanism and said fourth link mechanism for restricting the motion of said fourth link mechanism in a predetermined time period in the opening operation of said circuit breaker, thereby to drive said resistor contact after the opening of said two main contacts,

13. A circuit breaker according to claim 12, further comprising:

a fifth link mechanism for linking said first and second link mechanisms in such a manner that the resistor contacts are closed prior to the closing of said two main contacts during the closing operation of said circuit breaker.

14. A circuit breaker, comprising:

a tank filled with an insulation gas and having an axial direction along a horizontal axis;

two main contacts which are electrically connected in series in said tank in a manner such that main moving contacts of said main contacts are driven in the axial direction of said tank for contacting and departing from stationary main contacts of said main contacts;

series connections of resistors and a resistor contact which are respectively provided in said tank in such a manner that they are electrically connected in parallel with said main contacts when they and the main contacts are closed;

a first insulation operation rod and a second insulation operation rod which are driven in a direction that is perpendicular to the horizontal axis of said tank and provided between said main contacts;

a first link mechanism for coupling between a top end of said first insulation operation rod and one main contact of the two main contacts;

a second link mechanism for coupling between a top end of said second insulation operation rod and said resistor contact;

a first hydraulic operation mechanism and a second hydraulic apparatus which are provided below said tank;

a third link mechanism for coupling between a bottom end of said first insulation operation rod and said first hydraulic operation apparatus;

a fourth link mechanism for coupling between a bottom end of said second insulation operation rod and said second hydraulic operation apparatus; and a fifth link mechanism for linking said first and second link mechanisms in such a manner that the resistor contacts are closed prior to the closing of said two main contacts during the closing operation of said circuit breaker.

15. A circuit breaker, comprising:

a tank having an axial direction along an axis of the tank and filled with an insulation gas;

two main contacts which are electrically connected in series and provided in said tank in a manner such that main moving contacts of said two main contacts are driven in the axial direction of said tank for contacting and departing from stationary main contacts of said main contacts;

series connections of resistors and a resistor contact which are respectively provided in said tank in a manner such that they can be electrically connected in parallel with said two main contacts when they and the main contacts are closed;

a first insulation operation rod and a second insulation operation rod which are driven in a direction that is perpendicular to said axis of said tank and provided between said main contacts;

a first link mechanism for coupling between one end of said first insulation operation rod and one main contact of the two main contacts;

a second link mechanism for coupling between one end of said second insulation operation rod and said resistor contact;

a first hydraulic operation apparatus and a second hydraulic apparatus which are provided below said tank;

a third link mechanism for coupling between the other end said first insulation operation rod and said first hydraulic operation apparatus; and a fourth link mechanism for coupling between the other end of said second insulation operation rod and said second hydraulic operation apparatus; and a fifth link mechanism for linking said first and second link mechanisms in a manner such that said resistor contact is closed prior to the closing of said main contacts in the closing operation of said circuit breaker; and interlock means provided between said third link mechanism and said fourth link mechanism for restricting the motion of said fourth link mechanism in a predetermined time period in the opening operation of said circuit breaker so that said resistor contact are driven open after the opening of said two main contacts.

16. A circuit breaker in accordance with claim 15, wherein:

said second hydraulic operation apparatus comprises: a second hydraulic piston which is coupled to said fourth link mechanism; a cylinder wherein said second hydraulic piston is contained; and an accumulator connected to inner space of said cylinder through a pipe line for always supplying a high-pressure oil to said second hydraulic piston in a predetermined direction; and means for applying a driving force in a direction opposing said predetermined direction, said driving force is applied to said second hydraulic piston for charging a hydraulic driving force in said second hydraulic operation apparatus when said main contacts and said resistor contact are driven in closing operation by said first hydraulic operation apparatus.

17. A circuit breaker in accordance with claim 1, wherein:

said first hydraulic operation apparatus and said second hydraulic operation apparatus are positioned in a manner such that motion of said first and second hydraulic pistons are substantially horizontal and their moving directions oppose one another, but the elevations of said first and second hydraulic apparatuses are different; and interlock means, for restricting the motion of said fourth link mechanism, which is disposed between said third link mechanism and said fourth link mechanism.

* * * * *